US011933556B1

(12) United States Patent
Richter, III et al.

(10) Patent No.: US 11,933,556 B1
(45) Date of Patent: Mar. 19, 2024

(54) TUBE BUNDLE CLEANING SYSTEM AND METHOD

(71) Applicant: USA DeBusk LLC, Deer Park, TX (US)

(72) Inventors: Walter D. Richter, III, Deer Park, TX (US); Donald R. Drolet, Deer Park, TX (US); Ricky Eugene Smith, Deer Park, TX (US); Matthew Warwick, Deer Park, TX (US)

(73) Assignee: USA DeBusk LLC, Deer Park, TX (US)

( * ) Notice: Subject to any disclaimer, the term of this patent is extended or adjusted under 35 U.S.C. 154(b) by 0 days.

(21) Appl. No.: 18/299,433

(22) Filed: Apr. 12, 2023

Related U.S. Application Data

(60) Provisional application No. 63/445,788, filed on Feb. 15, 2023.

(51) Int. Cl.
*F28G 3/16* (2006.01)
*F28G 15/00* (2006.01)
*F28G 15/02* (2006.01)

(52) U.S. Cl.
CPC ..... *F28G 3/163* (2013.01); *F28G 15/003* (2013.01); *F28G 15/02* (2013.01)

(58) Field of Classification Search
CPC ..... F28G 3/163; F28G 15/003; F28G 15/02
See application file for complete search history.

(56) References Cited

U.S. PATENT DOCUMENTS 8,057,607 B2 11/2011 Gardner et al.
10,684,082 B2 6/2020 Mathis
2008/0302388 A1* 12/2008 Johns ..... F28G 1/12 134/8
2011/0155174 A1* 6/2011 Moll ..... B08B 9/027 226/188
2016/0025433 A1* 1/2016 Mathis ..... F28G 15/02 269/1
2017/0356702 A1* 12/2017 Gromes, Sr. ..... B24C 7/0015
2018/0281030 A1* 10/2018 Eisermann ..... B01D 29/66
2019/0039209 A1* 2/2019 Curran ..... F28G 9/00
2019/0163207 A1* 5/2019 Gromes, Sr. ..... F28G 15/02
2020/0132402 A1* 4/2020 Schneider ..... F28G 15/003
(Continued)

FOREIGN PATENT DOCUMENTS

WO WO-2018098556 A1 * 6/2018 ..... B08B 9/023

OTHER PUBLICATIONS

"What Abrasive Media Is Used in Vapor Blasting?", dated Feb. 9, 2022, pp. 1-12, Vapor Honing Technologies, Lincolnton NC, available at <https://vaporhoningtechnologies.com/what-abrasive-media-is-used-in-vapor-blasting/>.
(Continued)

*Primary Examiner* — Benjamin L Osterhout
(74) *Attorney, Agent, or Firm* — Pillsbury Winthrop Shaw Pittman LLP

(57) ABSTRACT

A tube cleaning system and method including a nozzle holder operable to secure nozzles in a nozzle arrangement, the nozzle arrangement corresponding to an arrangement of tubes of a tube bundle, and a nozzle positioning system operable to move the nozzle holder and nozzles secured therein, to cause the nozzles to engage a set of tubes of the tubes of the tube bundle, the nozzles configured to direct cleaning fluid into the set of tubes.

43 Claims, 14 Drawing Sheets

(56) References Cited

U.S. PATENT DOCUMENTS

| | | | | |
|---|---|---|---|---|
| 2020/0333093 | A1* | 10/2020 | Ferguson | F28G 15/04 |
| 2020/0356117 | A1* | 11/2020 | Gromes, Sr. | B24C 7/0015 |
| 2020/0356118 | A1* | 11/2020 | Gromes, Sr. | F28G 15/003 |
| 2020/0391257 | A1* | 12/2020 | Schneider | B08B 9/047 |
| 2021/0254912 | A1* | 8/2021 | Stickling | F28G 9/00 |
| 2021/0270550 | A1* | 9/2021 | Geppert | B08B 9/045 |
| 2022/0187854 | A1* | 6/2022 | Gromes, Sr. | F28G 15/08 |

OTHER PUBLICATIONS

"Why make an abrasive from insulation?", 2022, pp. 1-18, 10X Engineered Materials, LLC, Wabash, IN.

"Vapor Blast", dated Feb. 15, 2023, pp. 1-2, USA DeBusk, Deer Park, TX.

"Kinetix Safety Data Sheet", dated Aug. 8, 2022, pp. 1-5, 10X Engineered Materials, LLC, Wabash, IN, available at <https://10xem.com/wp-content/uploads/2022/08/SDS-for-Kinetix-v4.0-08182022.pdf>.

"Shell and tube heat exchanger", Wikipedia.org, retrieved Apr. 12, 2023, pp. 1-5, available at <https://en.wikipedia.org/wiki/Shell-and-tube_heat_exchanger>.

* cited by examiner

TUBE BUNDLE CLEANING SYSTEM AND METHOD

RELATED APPLICATIONS

This application claims benefit of and priority to U.S. Provisional Patent Application No. 63/445,788 titled "TUBE BUNDLE CLEANING SYSTEM AND METHOD" filed Feb. 15, 2023, the entirety of which is hereby incorporated by reference.

FIELD

Embodiments relate generally to industrial cleaning and more particularly to cleaning tubes of a tube bundle.

BACKGROUND

Industrial facilities and processes often rely on fluid flow through conduits. For example, many industrial cooling and heating systems and processes employ heat exchangers having fluid conduits that work to transfer heat between a source and a working fluid. This can include for example, shell and tube heat exchangers, double-pipe heat exchangers, plate heat exchangers and the like. Unfortunately, unwanted material, often referred to as "scale," can accumulate on surfaces of the conduits. In the context of shell and tube heat exchangers, for example, flowing water containing minerals, such as calcium, magnesium and silica, can lead to accumulation of scale, formed of the minerals or other deposits, on the walls of the heat exchanger tubing.

SUMMARY

Fouling caused by scale buildup can be detrimental to operation and efficiency of a system. In the case of fluid flow through tubing, scale can impede fluid flow and impede heat transfer across the walls of tubing. For example, in the case of a shell and tube heat exchanger that employs a set of tubes (or "tube bundle") disposed in a shell (e.g., a cylindrical pressure vessel), where a first fluid runs through the tubes, and a second fluid flows through the shell and over the tubes to transfer heat between the two fluids, material from the first fluid can create scale build up on the inside of the tubes and material from the second fluid can create scale build up on the outside of the tubes and on the interior of the shell. The scale and fouling can impede fluid flow through the tubes and shell, and impede heat transfer across the walls of the tubing, which can, in turn, reduce efficiency of the heat exchanger. This can be particularly detrimental for industrial systems and processes that rely on efficient fluid flow and heat exchange.

Unfortunately, cleaning tubes, such as those of tube bundles of shell and tube heat exchangers, can be time consuming and costly, and, if not done correctly, can be ineffective. Existing techniques often require a person to manually inject cleaning fluid into individual ones of the tubes, one at a time, typically spending a matter of minutes on each tube. Tube bundles often include tens or hundreds of individual tubes, and, thus, cleaning of a tube bundle can require a great deal of time and effort. In many instances, industrial processes that rely on a given system are shut down while the system is being cleaned. It is not uncommon for entire industrial processes to be shut down during a tubing cleaning operation, which can lead to substantial downtime and associated costs. Moreover, existing techniques often rely on an operator simply injecting cleaning fluid for what he or she believes to be an appropriate flow and amount of time for each tube, which can lead to inconsistent and incomplete cleaning of tubes.

Figure 1A:
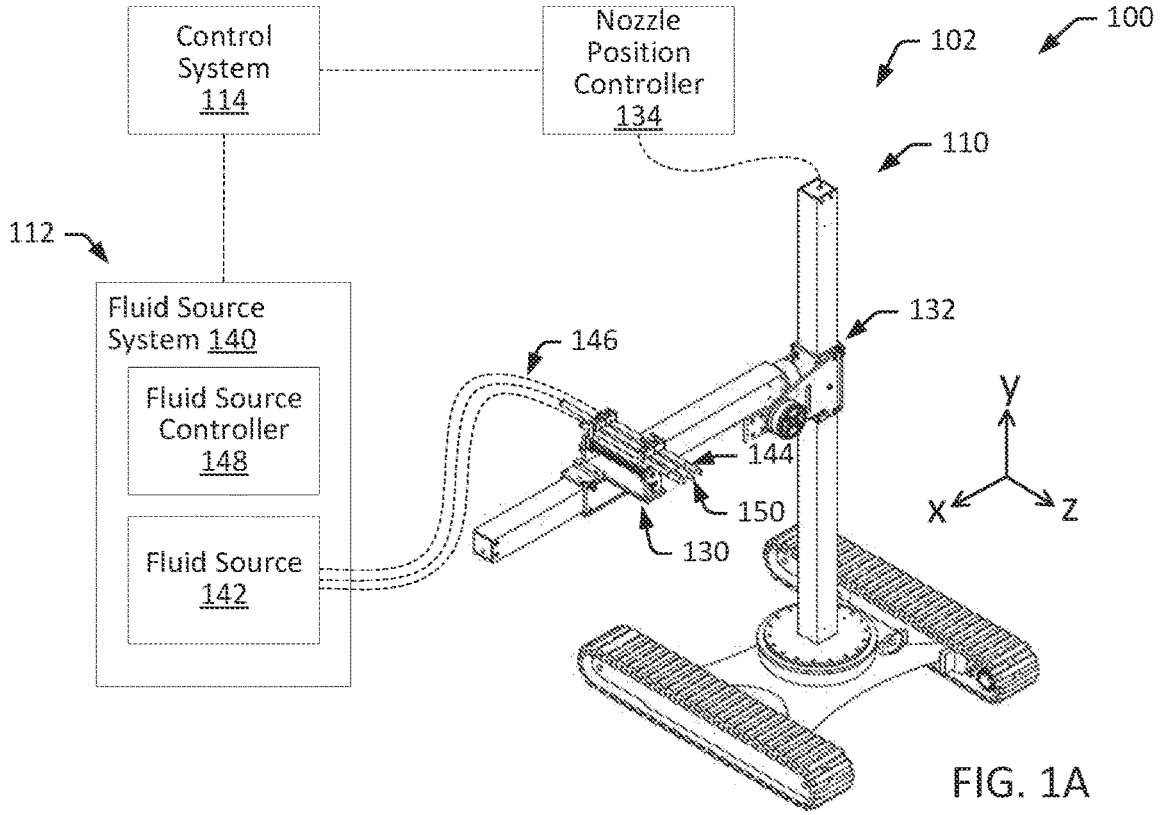
FIG. 1A is diagram that illustrates a cleaning environment in accordance with one or more embodiments.

While this disclosure is susceptible to various modifications and alternative forms, specific example embodiments are shown and described. The drawings may not be to scale. It should be understood that the drawings and the detailed description are not intended to limit the disclosure to the particular form disclosed, but are intended to disclose modifications, equivalents, and alternatives falling within the spirit and scope of the present disclosure as defined by the claims.

DETAILED DESCRIPTION

Provided are embodiments that provide for engagement of one or more nozzles with one or more tubes of a tube bundle. In some embodiments, cleaning of a tube bundle includes simultaneous engagement of multiple nozzles with multiple tubes of a tube bundle. For example, a tube bundle cleaning operation may include positioning a set of nozzles into engagement with a corresponding set of tubes of a tube bundle and injecting a cleaning media into the each of the tubes by way of the respective nozzles engaged therewith. In some embodiments, some or all of the operations of the cleaning operation are automated. Although certain embodiments are described in the context of certain types of conduit/tubes systems (e.g., heat exchangers), certain types of nozzles (e.g., non-rotating nozzles), certain types of cleaning operations (e.g., vapor blasting) and so forth, for the purpose of illustration, embodiments may be employed other contexts. For example, the positioning system may be employed to position nozzles or similar flow directors (e.g., rotating nozzles coupled to a shuttle of a positioning system) for cleaning of various types of equipment and components (e.g., heat exchanger heads, tube sheets, column trays or the like).

In some embodiments, a tube cleaning system includes a nozzle positioning system that is operable to secure multiple nozzles relative to one another in an arrangement that enables the nozzles to engage multiple tubes of a tube bundle (e.g., tubes of a tube bundle of a tube and shell type heat exchanger), operable to advance the multiple nozzles into engagement with multiple tubes of a tube bundle, and operable to retract the multiple nozzles to disengage the multiple tubes of the tube bundle. Such a system may, for example, enable simultaneous cleaning of multiple tubes of a tube bundle. As described, the tube cleaning system may be employed to conduct a cleaning operation that involves engaging, cleaning, and disengaging sets of tubes, repeating these operations for multiple sets of tubes (e.g., one set after the other), to provide relatively fast and efficient cleaning of tube bundles or similar tube-based systems.

In some embodiments, a method for cleaning tubes includes securing multiple nozzles (e.g. three nozzles) in an arrangement that enables the nozzles to simultaneously engage multiple tubes (e.g., three tubes) of a tube bundle (e.g., tubes of a tube bundle of a tube and shell type heat exchanger), conducting an engage operation that includes controlling the nozzle positioning system to advance the multiple nozzle assemblies into engagement with the multiple tubes of the tube bundle, conducting a cleanse operation comprising flowing cleaning fluid (e.g., including a cleaning/polishing media) through the nozzles (e.g., at a given flowrate, pressure and temperature for a given duration), such that the cleaning fluid flows into and through the tubes of the tube bundle, and conducting a disengage operation that includes controlling the nozzle positioning system to retract the plurality of nozzle assemblies to disengage the plurality of tubes of the tube bundle. Such a method may, for example, provide for simultaneous cleaning of multiple tubes of a tube bundle. In some embodiments, the method is repeated for other sets of tubes of the tube bundle. The cleaning fluid may be provided by a fluid source system. In some embodiments, the fluid source system provides separate fluid source lines to each of the multiple nozzle assemblies. In some embodiments, the cleanse operation comprises a vapor blast cleanse operation. For example, the cleaning/polishing media may include an abrasive media mixed with a fluid (e.g., water vapor or the like), and the cleanse operation may include a vapor blast cleanse operation that includes flowing the fluid and abrasive media mixture through the nozzle assemblies at into and through the plurality of tubes of the tube bundle (e.g., at a given flowrate, pressure and temperature for a given duration) to clean the interior surfaces of the tubes.

Figure 1B:
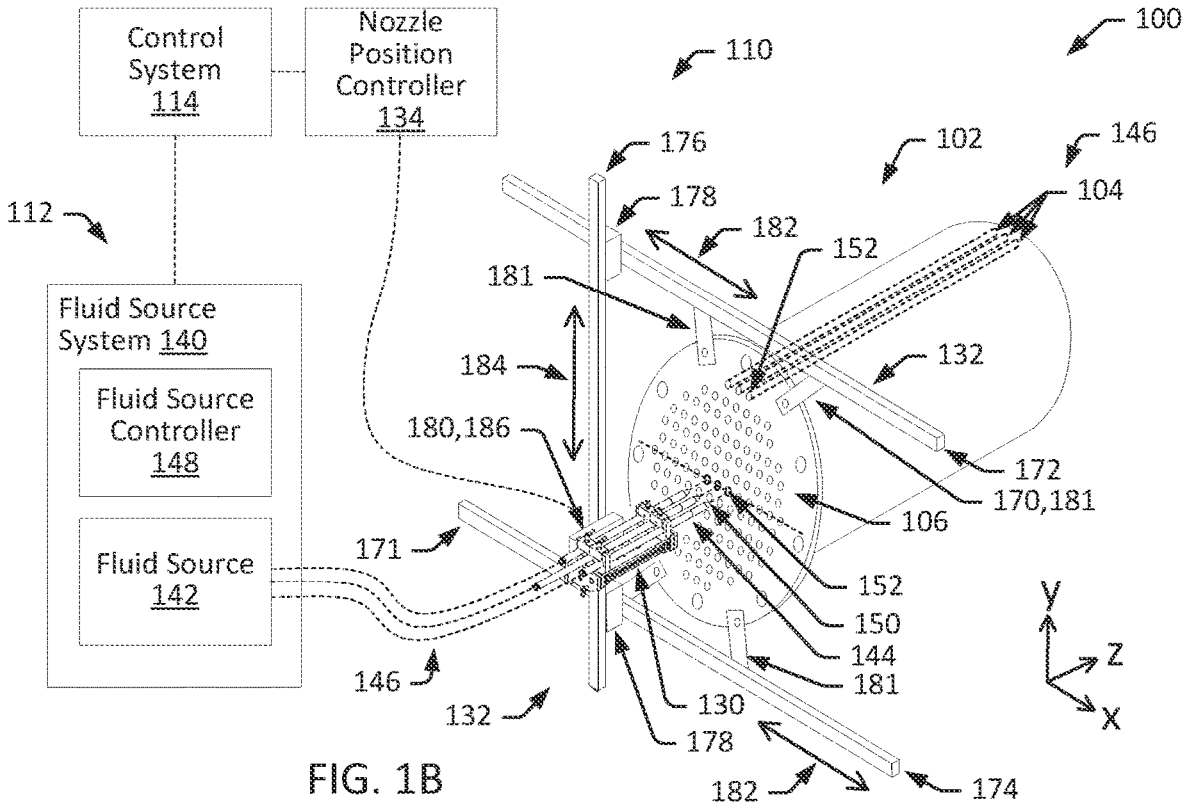
FIG. 1B is diagram that illustrates a cleaning environment employing a fixed-type nozzle holder positioning system in accordance with one or more embodiments.
Figure 2A:
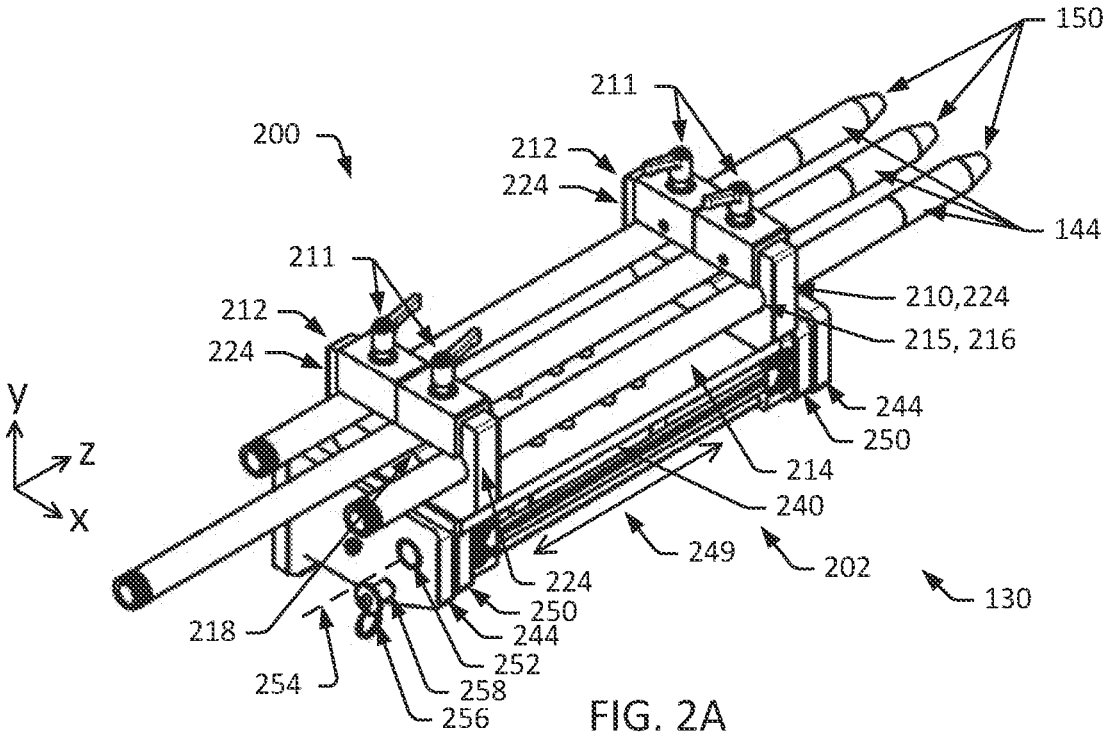
FIGS. 2A-2F are diagrams that illustrate various views of an example multi-nozzle adapter system (with nozzles present) in accordance with one or more embodiments.
Figure 2B:
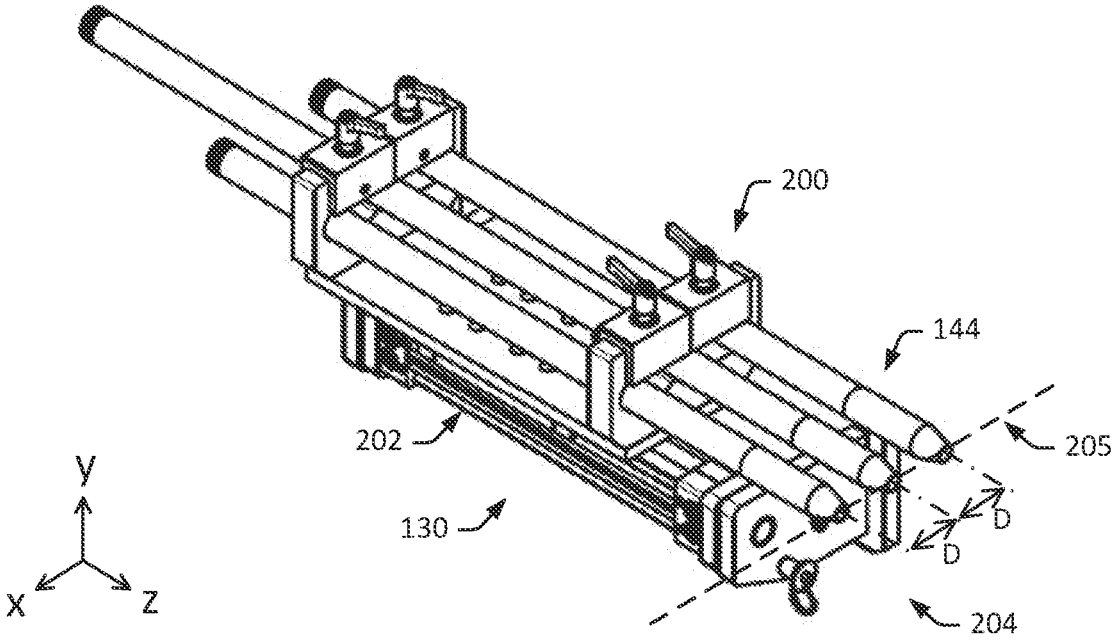
Figure 2C:
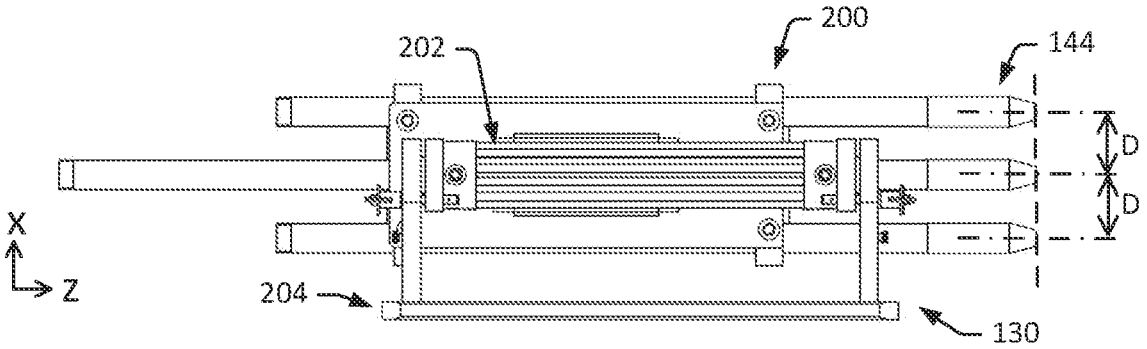
Figure 2D:
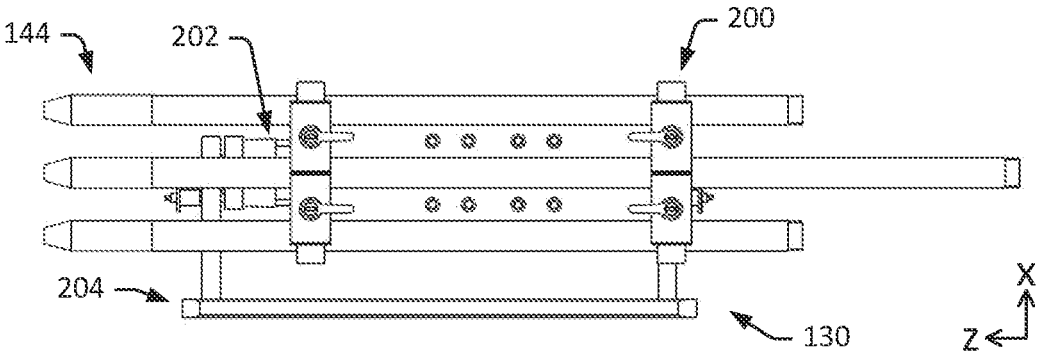
Figure 2E:
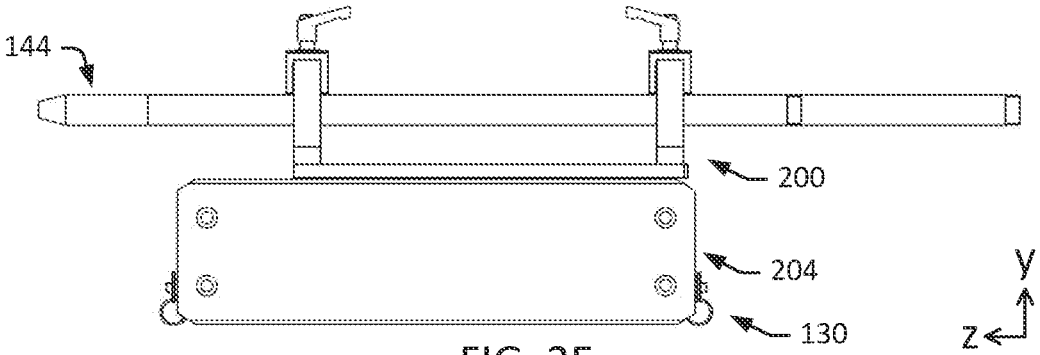
Figure 2F:
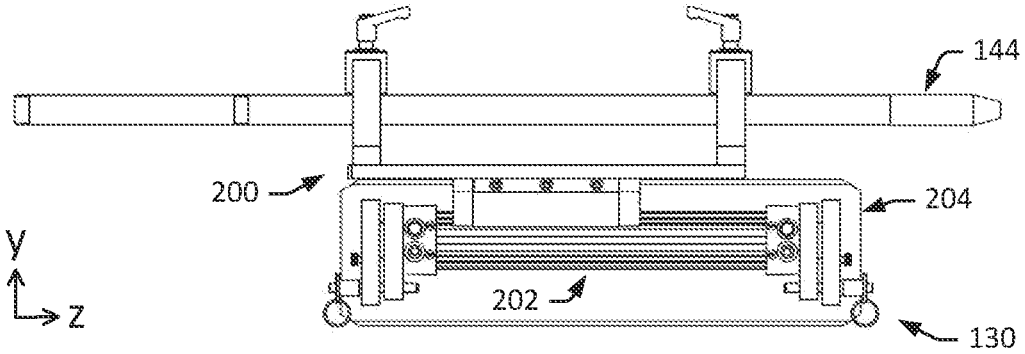
Figure 3A:
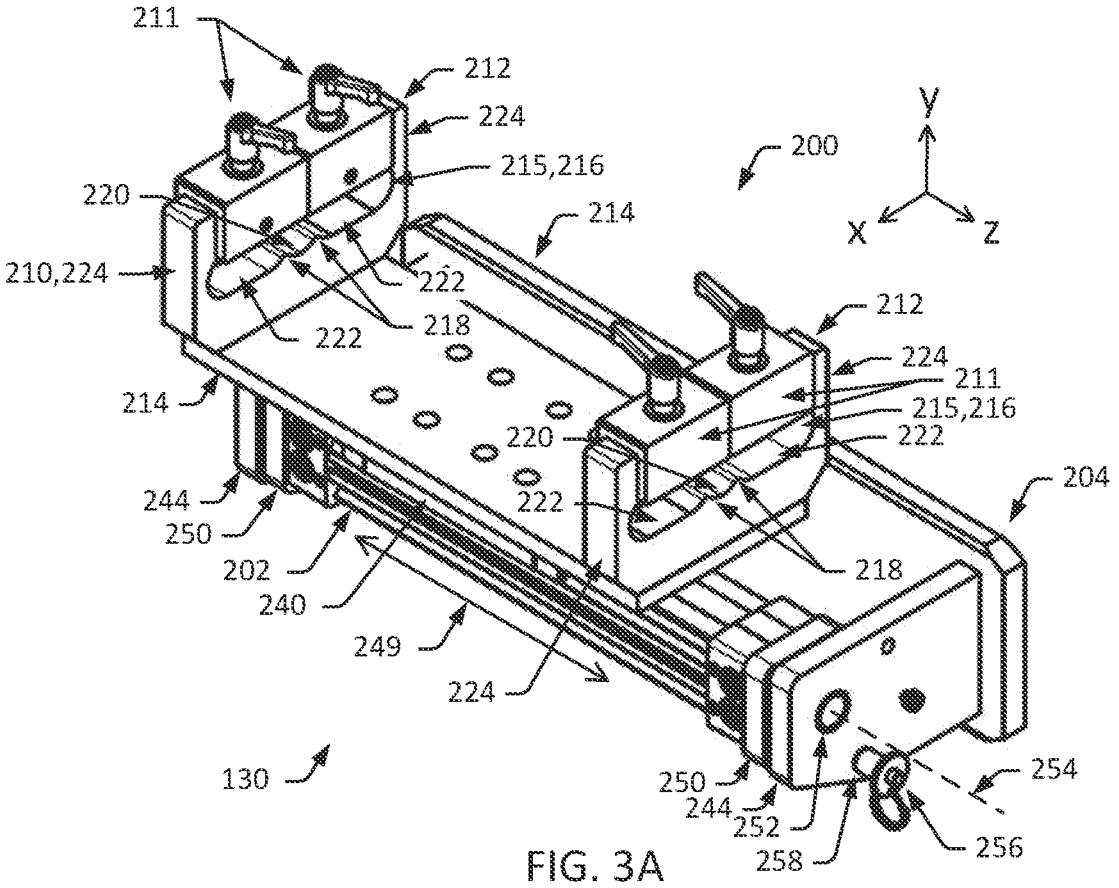
FIGS. 3A-3H are diagrams that illustrate various views of an example multi-nozzle adapter system in accordance with one or more embodiments.
Figure 3B:
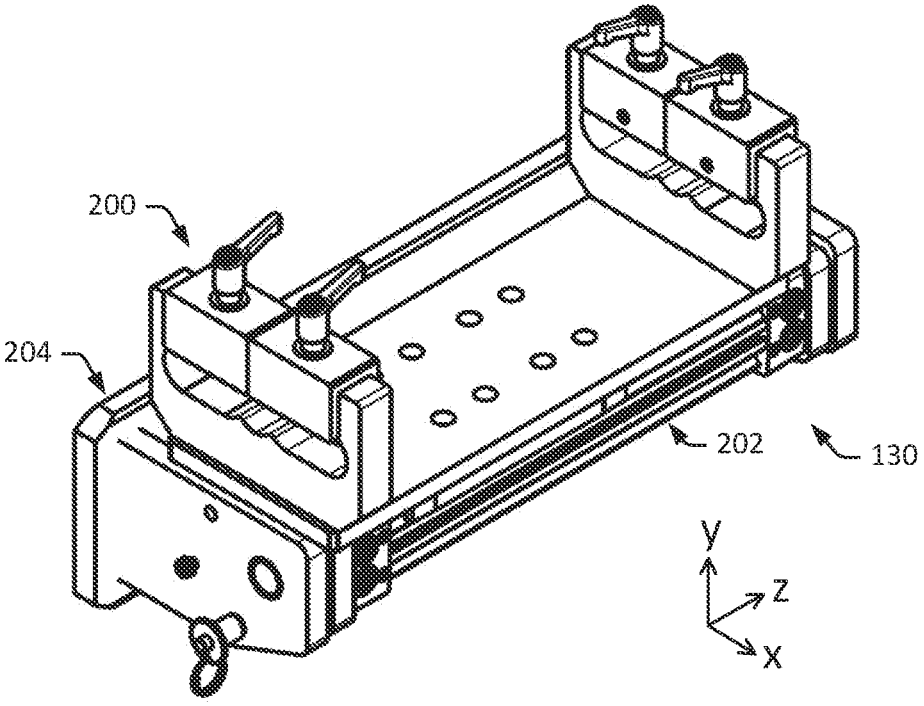
Figure 3C:
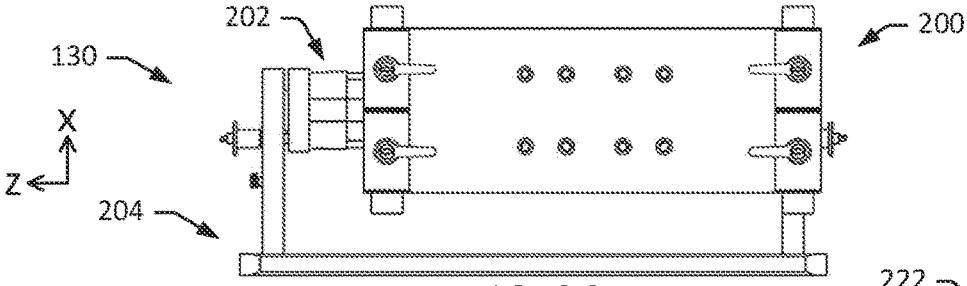
Figure 3D:
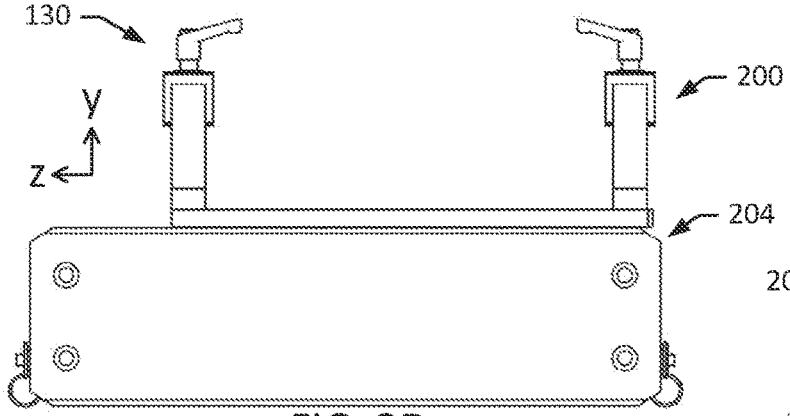
Figure 3E:
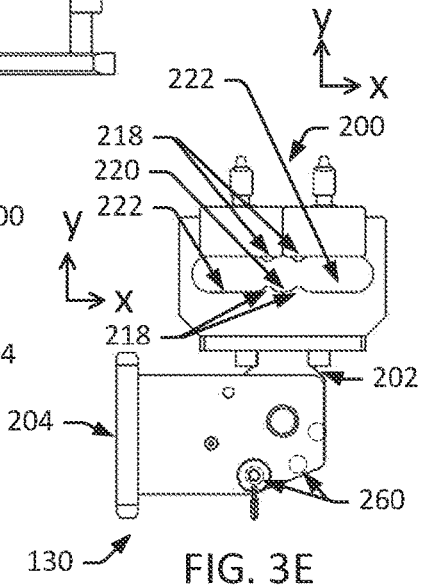
Figure 3F:
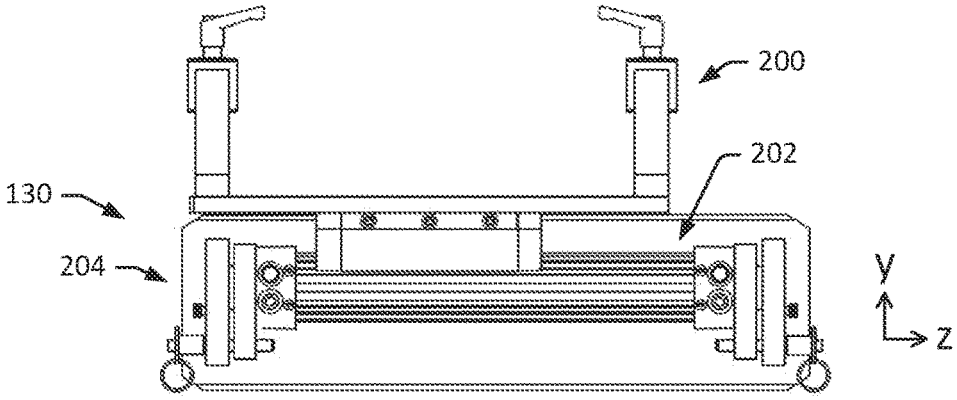
Figure 3G:
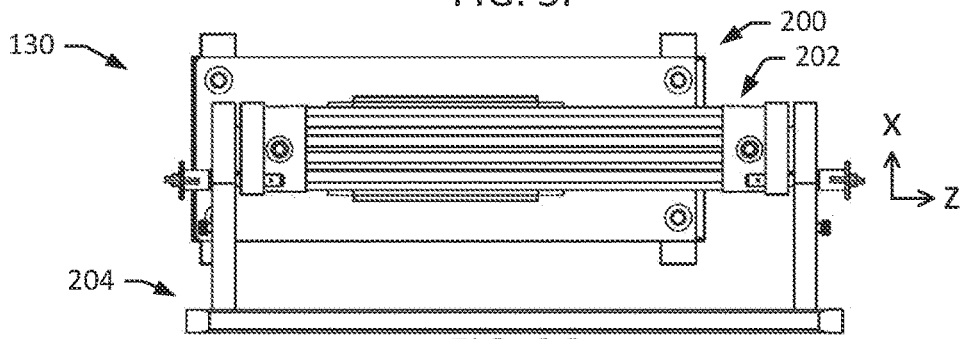
Figure 3H:
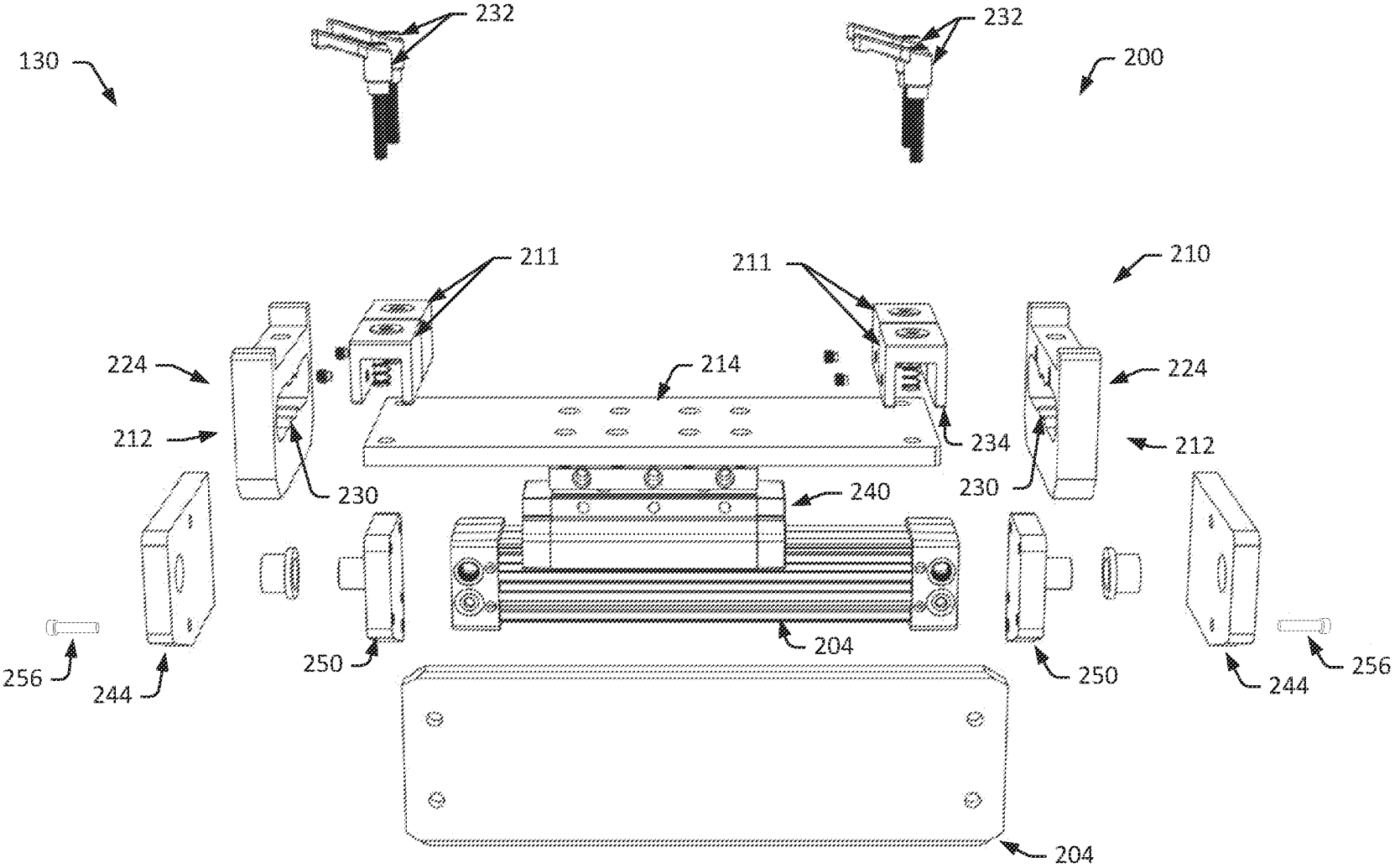
Figure 4A:
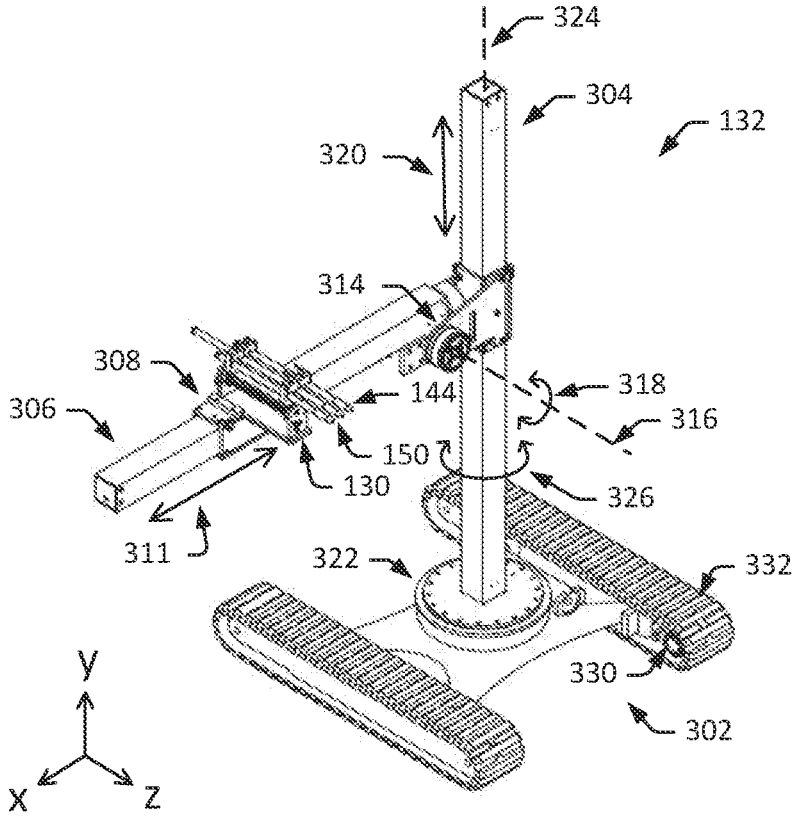
FIGS. 4A-4F are diagrams that illustrate various views of an example nozzle adapter positioning system in accordance with one or more embodiments.
Figure 4B:
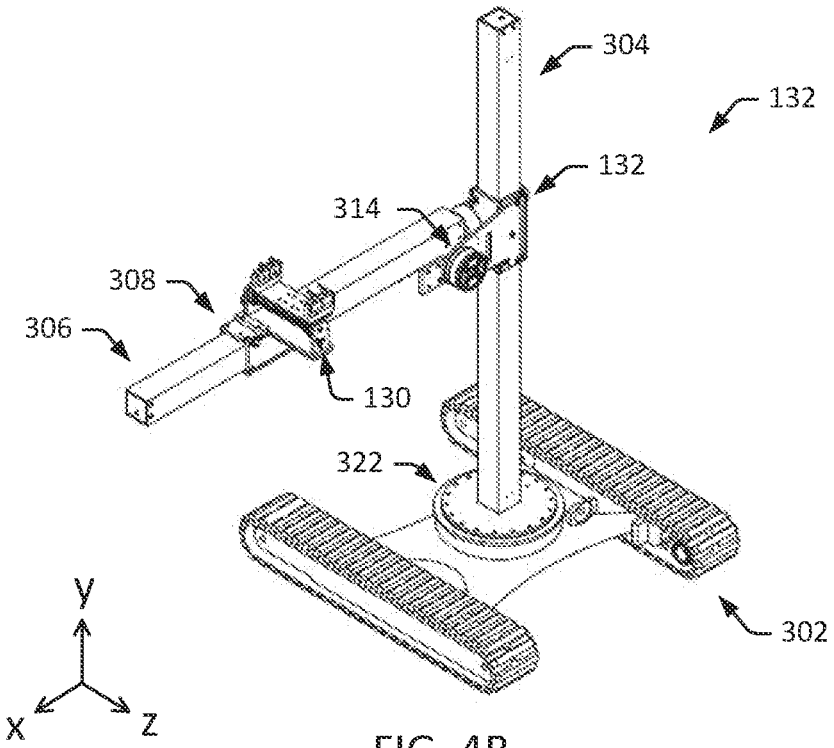
Figure 4C:
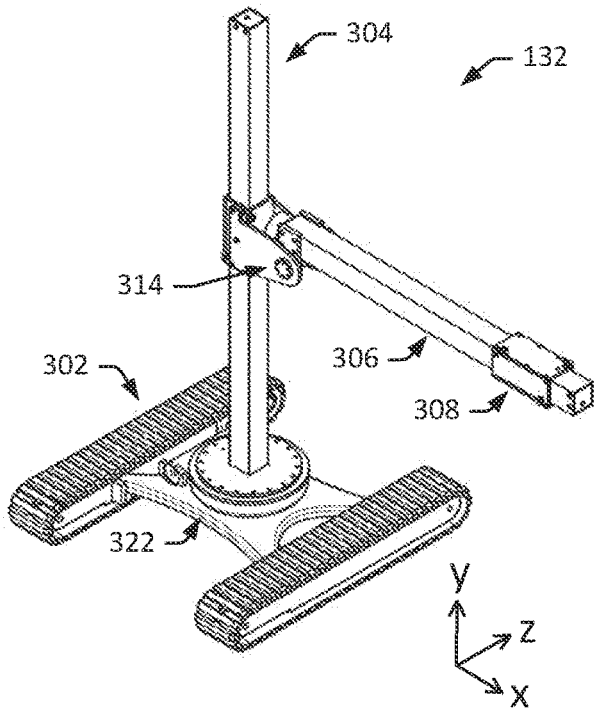
Figure 4D:
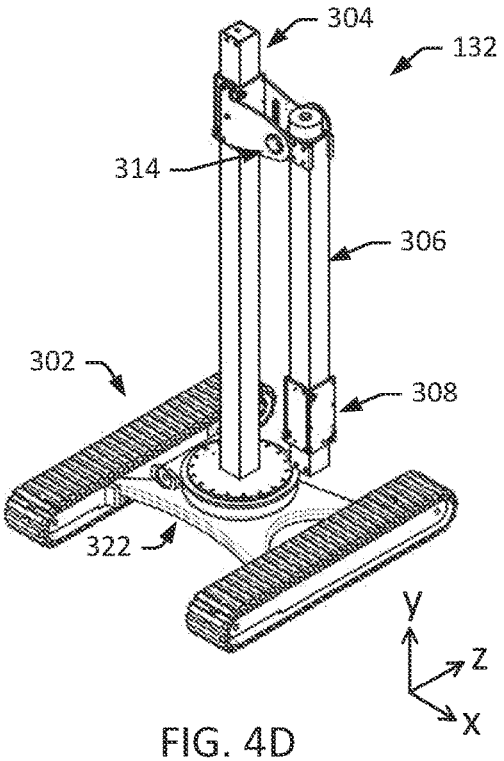
Figure 4E:
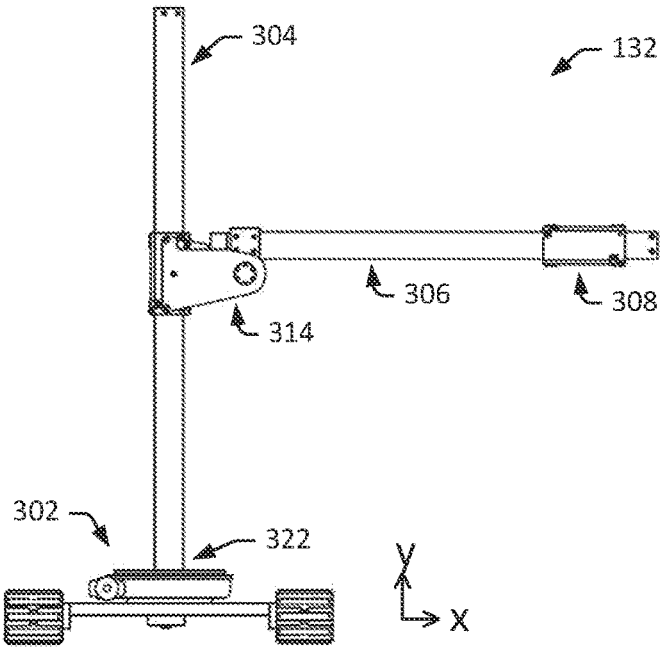
Figure 4F:
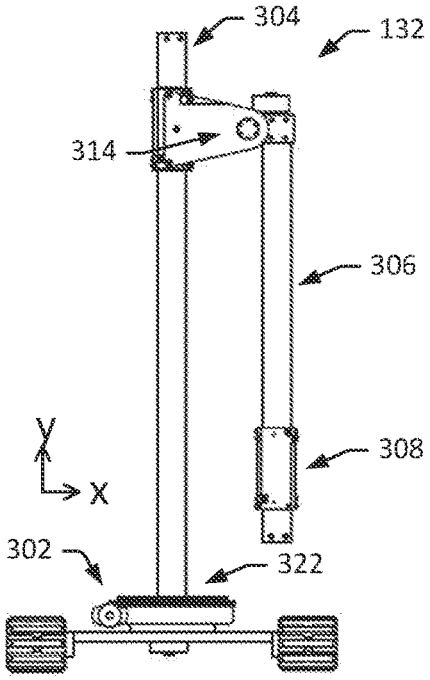
Figure 5A:
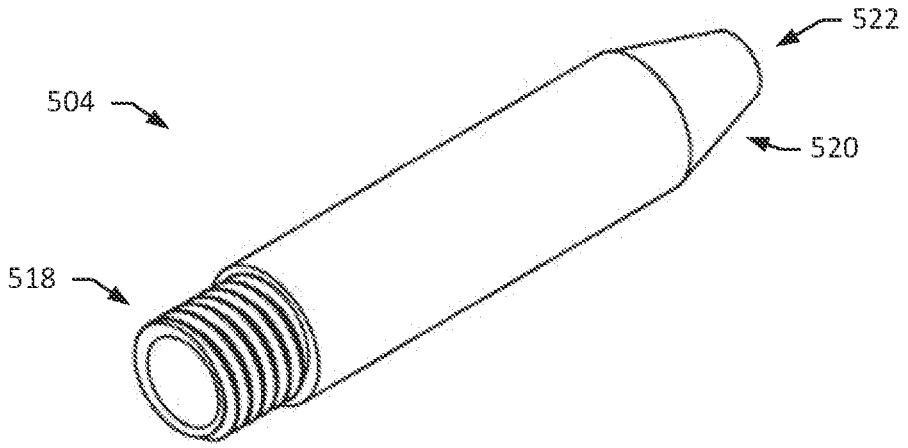
FIGS. 5A-5D are diagrams that illustrate various views of example components of a nozzle system in accordance with one or more embodiments.
Figure 5B:
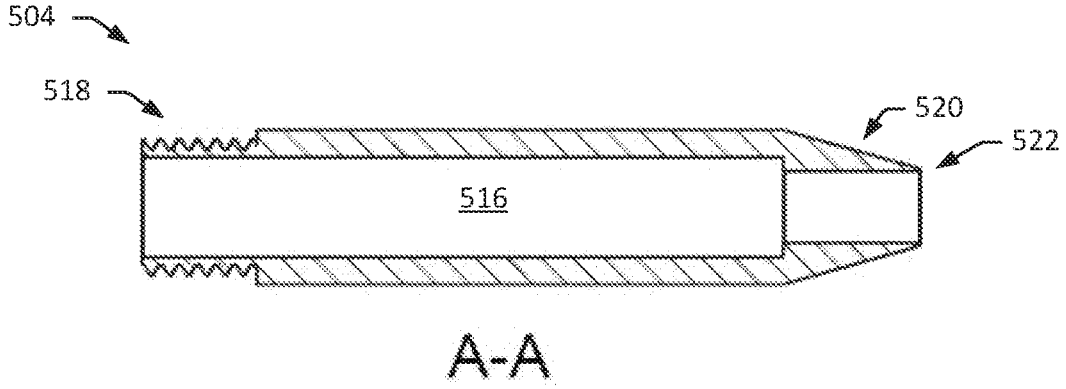
Figure 5C:
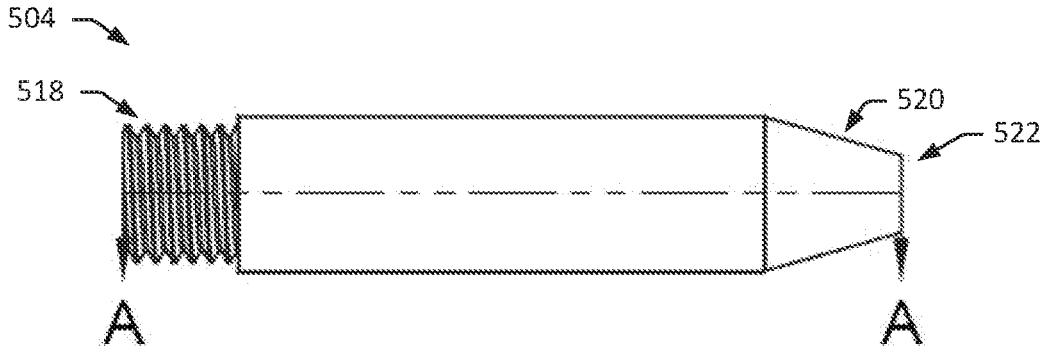
Figure 5D:
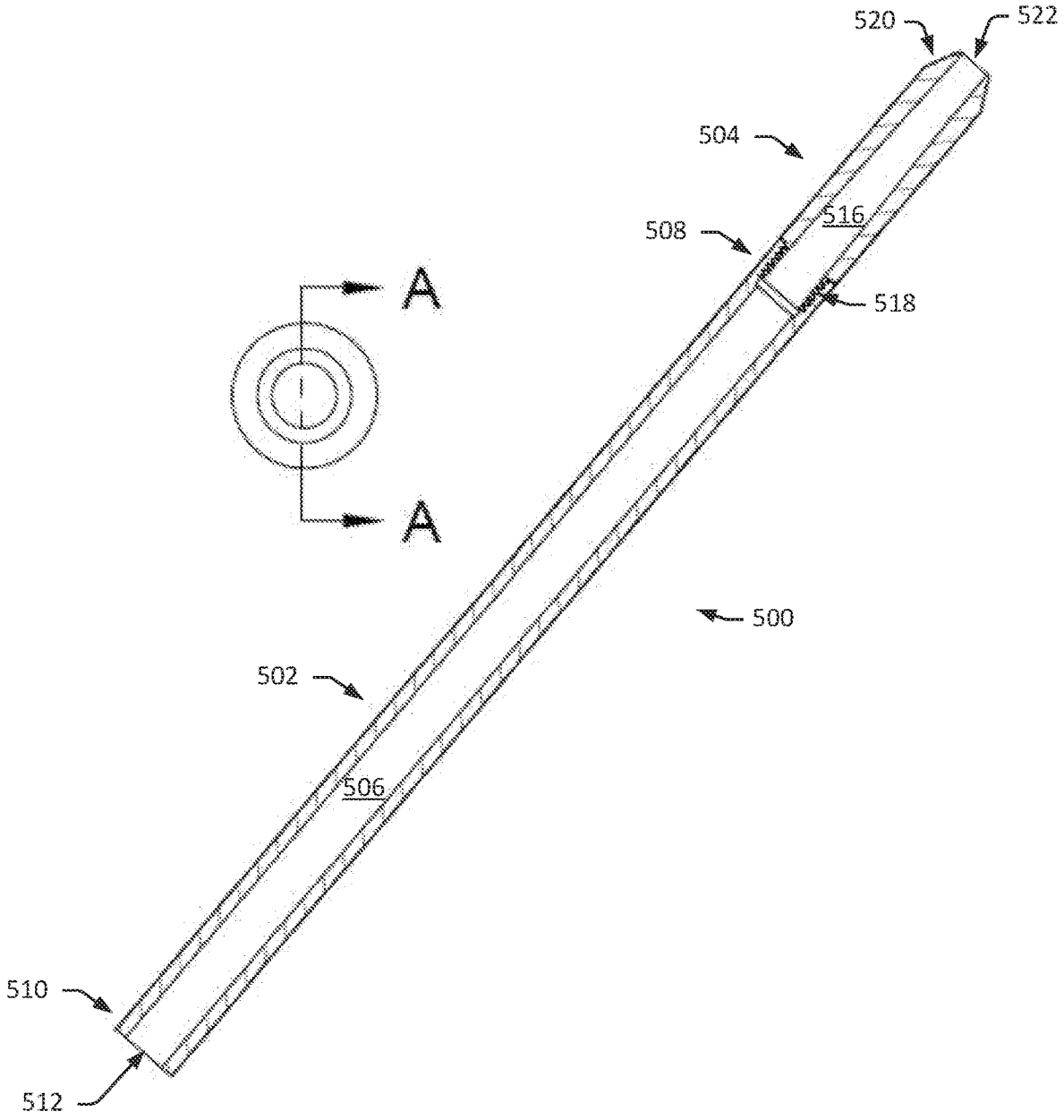

FIGS. 1A and 1B are diagrams that illustrate tube cleaning environments 100 in accordance with one or more embodiments. In the illustrated embodiment, each of the tube cleaning environments 100 includes a tube cleaning system 102. The tube cleaning system 102 may, for example, be operable to clean tubes 104 of a tube bundle 106 (see, e.g., FIG. 1B), or similar conduits of a tube-based system.

In the illustrated embodiments, the tube cleaning system 100 includes a nozzle positioning system 110, a fluid delivery system 112, and a control system 114. In some embodiments, the fluid delivery system 112 includes fluid delivery nozzles (or "nozzles") 144 that are operable to direct fluid (e.g., cleaning fluid) into tubes 104 of the tube bundle 106, and the nozzle positioning system 110 is operable to provide for positioning of a set of one or more nozzle assemblies relative to the tubes 104. This may include engaging the nozzles 144 with the tubes 104 to facilitate the nozzles 144 directing a stream of cleaning fluid into the tubes 104. For example, the nozzle positioning system 110 may be operable to position the set of three nozzles 144 depicted, into engagement with a corresponding set of three tubes 104 of the tube bundle 106. In such an embodiment, a stream of cleaning fluid (e.g., water vapor including cleaning media) may by directed into each of the three tubes 104 (e.g., at given flowrate for a given duration), where the streams of cleaning fluid act to remove scale or other deposits from the interiors of the tubes 104. In some embodiments, the control system 114 is a computer system that is the same or similar to computer system 1000 described with regard to FIG. 8.

In some embodiments, the fluid delivery system 112 is operable to provide cleaning fluid for a tube cleaning operation. For example, the fluid delivery system 112 may be operable to supply a cleaning fluid to the nozzles 144, where each of the nozzles 144 operates to direct a respective stream of the fluid into a corresponding tube 104 engaged by the nozzle 144. Flow of the fluid through a given tube 104 may act to remove scale or other deposits from the interior of the tube 104, or otherwise clean the interior of the tube 104. In some embodiments, aspects of the fluid or its delivery are controlled to provide a desired type or level of cleaning. For example, in a vapor blast type tube cleaning operation, the fluid may include a given fluid (e.g., water vapor) including an abrasive media (e.g., material particles) and the fluid may be passed through some or all of the tubes 104 at a given flowrate, pressure or temperature, or for a given duration, to provide a desired level of cleaning (or "polishing") of the interior walls of the tubes 104. In some embodiments, the abrasive media includes material particles of shape and size that facilitate the removal of deposits on the walls of the tubes 104. For example, the cleaning fluid may include an abrasive media such as KinetIX™ superalloy abrasive manufactured by 10× Engineered Materials of Wabash, Indiana, USA, or the like. Abrasive media may include, for example, abrasive media glass bead media, aluminum oxide media, garnet media, ground glass media, soda media, coal slag media, walnut shells media, silicon carbide media, corn cob media, steel shot media, stainless steel shot media, steel grit media, a combination of one or more of these, or the like.

In some embodiments, the nozzle positioning system 110 includes a nozzle adapter system (or "nozzle holder") 130, a nozzle adapter positioning system (or "nozzle holder positioning system") 132, and a nozzle position controller (or "position controller") 134. As described, the position controller 134 may control the nozzle holder positioning system 132 to move and position the nozzle holder 130 and any nozzles 144 secured therein. In some embodiments, the position controller 134 is a computer system that is the same or similar to computer system 1000 described with regard to FIG. 8.

In some embodiments, the fluid delivery system 112 includes a fluid source system 140, including a fluid source 142, one or more fluid delivery nozzles 144 (e.g., coupled to the fluid source 142 by way of respective fluid delivery lines 146), and a fluid source controller (or "fluid delivery controller") 148. As described, the fluid source 142 may include a source of fluid and one or more pumps and valves, and the fluid delivery controller 148 may control the fluid source 142 to operate one or more pumps and valves to direct pressurized fluid, from the fluid source, through the fluid delivery line(s) 146 and the fluid delivery nozzle(s) 144. Fluid may exit a nozzle 144 by way of an outlet 150 of the nozzle 144. As described, the outlet 150 of a nozzle 144 may be aligned and engaged with an inlet 152 of a tube 104 of the tube bundle 106 to provide for directing a stream of cleaning fluid into the tube 104. In some embodiments, the fluid delivery controller 148 is a computer system that is the same or similar to computer system 1000 described with regard to FIG. 8.

In some embodiments, the fluid source system 140 is operable to provide individual control of fluid flow to a given nozzle 144. For example, the fluid delivery controller 148 may control the fluid source 142 to operate pumps, valves or the like to direct (or inhibit) fluid flow through one, some, or all of the fluid delivery lines 146 to enable (or disable) fluid flow through a corresponding one, some, or all of the nozzles 144. Thus, for example, the fluid source system 140 may operate to direct cleaning fluid to the first of three nozzles 144, while inhibiting flow to the other two of the three nozzles 144. This may be useful, for example, where the first nozzle 44 is engaged with a tube 104 that has not yet been cleaned, and the other two nozzles 144 are engaged with tubes 104 that have already been cleaned or otherwise would not benefit from introduction of cleaning fluid. Or may be useful, for example, in a case where the nozzles 144 can be independently engaged (e.g., as described with regard to at least FIGS. 7A and 7B), and the first nozzle 44 is engaged with a tube 104 that has not yet been cleaned and the other two nozzles 144 are not engaged with tubes 104. The fluid delivery controller 148 may operate pumps, valves, heaters or the like to vary characteristics (e.g., media type, flowrate, pressure, temperature), of the fluid being provided through one, some, or all of the fluid delivery lines 146 to enable independent control of fluid flow parameters for fluid flow through each of the nozzles 144. For example, the fluid source system 140 may operate to direct cleaning fluid with a first set of parameters (e.g., a first media type, at a first combination of flowrate, pressure and temperature) to the first of the three nozzles 144, and to direct cleaning fluid with a second set of parameters (e.g., a second media type, at a second combination of flowrate, pressure and temperature) to the other two nozzles 144.

The illustrated axes and associated labels and descriptions are provided for the purpose of explanation for the portions being described. It will be appreciated that the labeled/described axes may be different in certain implementations. For example, when the nozzle holder 130 is installed on a positioning system, the labels of the axes of the nozzle holder 130 may or may not match the corresponding axes labels of the positioning system. In general, the Z-axis/direction is used to refer to an axis/direction that is generally parallel to longitudinal axes of tubes 104 to be engaged, unless indicated otherwise.

In some embodiments, the nozzle positioning system 110 is operable to provide for movement and positioning of one or more nozzles 144 secured therein. For example, the nozzle positioning system 110 may be a multi-dimensional positioning system that is operable to move nozzles 144 secured in the nozzle holder 130 laterally (e.g., side-to-side, generally normal to a longitudinal axis of one or more of the nozzles 144 secured therein, as illustrated by the X and Y axes of FIGS. 1A and 1B) or longitudinally (e.g., forward and backward, in a direction generally parallel to a longitudinal axis of one or more of the nozzles 144 secured therein, as illustrated by the Z axis of FIGS. 1A and 1B) In such an embodiment, the lateral movement may provide for aligning nozzles 144 with a corresponding set of tubes 104 of the tube bundle 106, and the longitudinal movement may provide for engagement or disengagement of nozzles 144 with the corresponding set of tubes 104 of the tube bundle 108. As described, the nozzle positioning system 110 may, for example, be operable to align the nozzles 144 with a first set of tubes 104 of the tube bundle 106, advance the nozzles 144 to engage the first set of tubes 104 for a cleaning operation, retract the nozzles 144 to disengage the nozzles 144 from the first set of tubes 104 (e.g., after the cleaning operation is complete for the first set of tubes 104), align the nozzles 144 with a second set of tubes 104 of the tube bundle 106, advance the nozzles 144 to engage the second set of tubes 104 for a second cleaning operation, retract the nozzles 144 to disengage the nozzles 144 from the second set of tubes 104 (e.g., after the cleaning operation is complete for the second set of tubes 104), and so forth. This iterative engaging/cleaning/disengaging of tubes 104 may be repeated, for example, until a desired set of tubes 104 (e.g., a given number, a given region, all, or substantially all, of the tubes 104 of the tube bundle 106) are cleaned.

In some embodiments, the nozzle holder 130 is operable to secure one or more nozzles 144. For example, the nozzle holder 130 may include a device that is operable to secure one or more nozzles 144 for use in directing cleaning fluid into one or more tubes 104 of the tube bundle 106, or other conduits. In some embodiments, the nozzle holder 130 secures the one or more nozzles 144 in an arrangement (a "nozzle arrangement") that provides for engagement of an outlet (or "tip") 150 of each of the one or more nozzles 144 with an inlet 152 of a corresponding tube 104 of the tube bundle 106.

In some embodiments, the nozzle holder 130 is a multi-nozzle adapter system (or "multi-nozzle holder") operable to physically secure multiple nozzles 144 in position relative to one another. For example, the nozzle holder 130 may include multi-nozzle holder device that is operable to secure two or more nozzles 144 relative to one another for use in directing cleaning fluid into two or more tubes 104 of the tube bundle 106. In some embodiments, the nozzle holder 130 is operable to secure two or more nozzles 144 relative to one another in a given nozzle arrangement. The nozzle arrangement may, for example, correspond to an arrangement of tubes 104 or other conduits to be engaged by the two or more nozzles 144. For example, where tubes 104 of the tube bundle 106 are arranged in a pattern having a linear arrangement (e.g., having inlets 152 generally arranged along a line with a given spacing (or "pitch"), the nozzle holder 130 may be operable to secure the two or more nozzles 144 relative to one another in a linear arrangement that corresponds to the linear arrangement of the tubes 104 of the tube bundle 106 (e.g., having outlets 150 generally arranged along a line with the nozzles being offset from one another by the given spacing (or "pitch")). Although a linear arrangement is described for the purpose of illustration, it will be appreciated that other suitable arrangements may be employed, such as a triangular arrangement, square/rectangular arrangement, or the like.

In some embodiments, securing two or more nozzles 144 in a nozzle arrangement corresponding to an arrangement of tubes 104 to be engaged by the two or more nozzles 144 provides for simultaneous engagement of the two or more nozzles 144 with a corresponding set of two or more tubes 104. For example, securing three nozzles 144 in a linear arrangement corresponding to a linear arrangement of tubes 104 of the tube bundle 106 to be engaged and cleaned enables the nozzle holder 130 and the three nozzles 144 to be advanced together (as a unit) into simultaneous engagement with a corresponding set of three tubes 104 of the tube bundle 106. Such simultaneous engagement may enable cleaning fluid to be simultaneously directed into each of the two or more nozzles 144 during a cleaning operation This may enable simultaneous cleaning of the corresponding set of two or more tubes 104 engaged by the two or more nozzles 144. Continuing with the above example having three nozzles 144 secured in a linear nozzle arrangement, during a cleaning operation for the tube bundle 106, the three nozzles 144 may be advanced into simultaneous engagement with three tubes 104 of the tube bundle 106. Cleaning fluid may, then, be simultaneously directed through the three nozzles 144 to provide simultaneous cleaning of the three tubes 104 engaged by the three nozzles 144. As described, in some embodiments, the fluid flow through a nozzle 144 may be independently controllable, such that fluid flow can be selectively enabled/disabled for respective nozzles 144. For example, the fluid delivery controller 148 may control the fluid source 142 to operate the pump and valves to direct (or inhibit) fluid flow through one, some, or all of the fluid delivery lines 146 to enable (or disable) fluid flow through a corresponding one, some, or all of the nozzles 144.

In some embodiments, two or more nozzles 144 in a nozzle arrangement and the nozzles 144 are independently movable/advanceable to move one, some or all of the nozzles 144 into engagement with a corresponding tube 104. For example, as described with regard to at least FIGS. 7A and 7B, one or more nozzles 144 of a set of nozzles may be advanced into engagement with a tube 104, while one or more other nozzles 144 of the set of nozzles are not advanced, such that they remain unengaged. This may be useful, for example, where the first nozzle 144 is to be engaged with a tube 104 that has not yet been cleaned for a cleaning operation, and the other two nozzles 144 are aligned with a tube 104 the tube bundle 106 that does not need to be cleaned (e.g., a tube that has already been cleaned) or cannot be cleaned (e.g., a tube that is capped/plugged), are not aligned with a tube 104, or the like.

Engagement of a nozzle 144 with a tube 104 may include sealing contact, contact or near contact between the outlet 150 of the nozzle 144 and the inlet 152 of the tube 104. Sealing contact may include providing a fluid seal between the outlet 150 of the nozzle 144 and the inlet 152 of the tube 104 that is operable to direct all or substantially all (e.g., greater than 75%, 85% or 95%) of the fluid flow from the nozzle 144 into the tube 104. Contact may include providing some level of physical contact between the outlet 150 of the nozzle 144 and the inlet 152 of the tube 104 that is operable to provide for directing all, substantially all, or a majority (e.g., greater than 50%) of the fluid flow from the nozzle 144 into the tube 104. Near contact may include the outlet 150 of the nozzle 144 and the inlet 152 of the tube 104 physically near one another (e.g., within 0.125, 0.25, 0.5, 1, 2, 3, 4, or 5 inches) to provide for directing all, substantially all, or a majority of the fluid flow from the nozzle 144 into the tube 104. Engagement of a nozzle 144 and a tube 104 may include, for example, the outlet 150 of the tube 104 being in positioned at or near the inlet 152 of the tube to facilitate the nozzle 144 directing a sufficient amount of fluid into the tube 104. A sufficient amount of fluid may be defined, for example, by a given fluid volume (e.g., 10 gallons), a given flow rate (e.g., 10 gallons per minute of fluid flow, 10 pounds per minute of fluid/media flow, or the like), or portion (e.g., 75%) of fluid flow through the nozzle, that is sufficient to provide a desired level of cleaning of the tube 104 (e.g., to meet a specified level of cleaning/polishing of the tube 104).

FIGS. 2A-2F are diagrams that illustrate various views of an example nozzle holder system 130 (a multi-nozzle holder shown with three nozzles 144 secured therein) in accordance with one or more embodiments. FIGS. 3A-3H are diagrams that illustrate various views of an example nozzle holder system 130 (a multi-nozzle holder shown without nozzles secured therein) in accordance with one or more embodiments. Although a nozzle holder system operable to secure three nozzles is depicted and described for the purpose of illustration, embodiments may include any suitable number and arrangement of nozzles. For example, similar embodiments may include a nozzle holder system 130 operable to secure two, four, five, six, seven, eight, nine, ten or more nozzles 144.

In the illustrated embodiment, the nozzle holder system 130 includes a nozzle holder cradle system (or "nozzle cradle") 200, a nozzle holder cradle slide mount system (or "slide mount") 202 and a nozzle holder base system (or "base") 204. As illustrated, the nozzle holder system 130 is operable to secure three nozzle 144 therein, in a linear arrangement. For example, the three nozzles 144 are secured in place in the nozzle cradle 200 in a planar fashion (e.g., with their longitudinal axes in the same plane) with their outlets 150 aligned linear (e.g., along a line 205) and offset from one another by a given distance (D) (or "pitch" or "spacing") (see, e.g., FIGS. 2B and 2C).

In the illustrated embodiment, the nozzle cradle 200 includes a nozzle cradle body 210, and nozzle retainers 211. The nozzle cradle body 210 includes cradle ends 212 rigidly coupled to one another by a cradle base plate 214. Each of the cradle ends 212 includes an opening 215 that defines a respective nozzle rest 216. Each nozzle rest 216 includes two raised portions (or "detents") 218 that define a central portion 220 of the nozzle rest 216 and two side portions 222 of the nozzle rest 216 (see, e.g., FIGS. 3A and 3E). The central portion 220 may be a recessed surface defined by a portion of the surface of the nozzle rest 216 (or "valley") located between the peaks of the two raised portions (or "detents") 218. The central portion 220 may be operable to capture the body (or "barrel") of a single nozzle 144, where the detents 218 operate to inhibit lateral (e.g., side-to-side) movement of the single nozzle 144 on the nozzle rest 216. The detents 218 may be located relatively close to one another to define a relatively narrow central portion 220 (or "valley") that acts to inhibit lateral movement of the single nozzle 144, such that the single nozzle 144 is "centered" between the detents 218 when disposed on the central portion 220 of the nozzle rest 216.

The side portions 222 may be a recessed surface defined by a portion of the surface of the nozzle rest 216 (or "valley") located between a respective peak of each of the detents 218 and an adjacent one of vertically extending sides 224 of the cradle end 212. Each of the side portions 222 may be operable to capture the body of a single nozzle 144, where the associated detent 218 and arm 224 operate to limit lateral (e.g., "side-to-side") movement of the single nozzle 144 on the nozzle rest 216. The detents 218 may be located relatively far from the adjacent sides 224 to define relatively wide side portions 222 (or "valleys") that acts facilitate adjustment of lateral positioning of the single nozzle 144 in the respective side portion 222. This may enable a single nozzle 144 to be moved into various positions along the surface of a side portion 222 of nozzle rest 216.

As described, one or more nozzle retainers 211 may be tightened to secure (or "fix") the position of nozzles 144 in the central portion 220 of the nozzle rest 216 or the side positions of nozzles of the nozzle rest 216. The detents 218 may act to provide for centering of a first nozzle 144, while allowing variations/adjustments of the lateral positions of nozzles 144 on either side of the first nozzle 144. Such a nozzle rest 216 may provide flexibility in positioning nozzles 144 relative to one another, therein. For example, where it is desirable for the nozzles 144 to have a linear arrangement corresponding to a pitch (e.g., a distance between adjacent nozzles 144 that corresponds to a pitch/distance between adjacent tubes 104 to be engaged by the nozzles 144), a first of the three nozzles 144 may be secured in the valley of central portion 220 (e.g., where it is "centered" within the nozzle rest 216), and each of the other two of the three nozzles 144 may be secured in a respective one of the valleys of the side portions 222, in a position where it is spaced from the first nozzle 144 according to the pitch. For example, where the pitch (D) is a relatively small distance (e.g., 1 inch (in)), the second and third nozzles 144 may each be disposed in the valley of a respective side portion 222 such that their longitudinal axis is spaced the small distance (e.g., 1 inch) from the longitudinal axis of the first nozzle 144 disposed in the valley of central portion 220. Where the pitch (D) is a relatively large distance (e.g., 2 inches), the second and third nozzles 144 may each be disposed in the valley of a respective side portion 222 such that their longitudinal axis is spaced 2 inches from the longitudinal axis of the first nozzle 144 disposed in the valley of central portion 220.

In some embodiment, the nozzle cradle retainers 211 are operable to physically secure one or more of the nozzles 144 into position within the nozzle cradle 200. In the illustrated embodiment, the nozzle cradle 200 includes four nozzle cradle retainers 211, that are each secured to an upper portion 230 of a respective cradle end 212 by way of a respective threaded retainer adjustment screw 232 (see, e.g., FIG. 3H). During use, the retainer adjustment screw 232 of a retainer 211 may be rotated in a first direction (e.g., clockwise) to draw the retainer 211 downward, such that an underside 234 of the retainer 211 is moved into contact with an upper surface of a nozzle 144 located thereunder, to clamp the nozzle 144 between the underside 234 of the nozzle cradle retainer 211 and the surface of the nozzle rest 216 abutting the nozzle 144 from below (e.g., the surface of the central portion 220 or one of the side portions 222). The resulting clamping force may act to secure (or "fix") the nozzle 144 into a position within the nozzle cradle 200. As illustrated, each of the nozzle cradle retainers 211 may have a portion of its underside 234 located above a portion of the central portion 220 of the nozzle rest 216 and a portion of its underside 234 located above one of the two side portions 222 of the nozzle rest 216. Such an embodiment may enable tightening of a given nozzle cradle retainer 211 to simultaneously secure a nozzle 144 located in the central portion 220 of the nozzle rest 216 and a nozzle located in a side portion 222 of the nozzle rest 216 located there below. The retainer adjustment screw 232 may be rotated in a second direction (e.g., counterclockwise) to enable the retainer to move upward, to release an associated clamping force acting on one or more nozzles 144 located between the underside 234 of the nozzle cradle retainer 211 and the surface of the nozzle rest 216 abutting the nozzle 144 from below (e.g., the surface of the central portion 220 or one of the side portions 222). This may eliminate the clamping force or contact with an upper surface of a nozzle 144 located thereunder, to, for example, facilitate repositioning of the one or more nozzles 144 within the cradle 200 or the removal of the one or more nozzles 144 from the cradle 200.

In some embodiments, the cradle 200 (and nozzles 144 secured therein) is operable to translate relative to the base 204. This may, for example, provide for moving the nozzles 144 secured by the cradle 200 forward and backward, into and out of engagement with corresponding tubes 104 of the tube bundle 106. For example, in the illustrated embodiment, the slide mount 202 provides for coupling of the cradle 200 to the base 204, and is operable to provide for translation of the cradle 200 (and nozzles 144 secured therein) relative to the base 204. In the illustrated embodiment, the cradle baseplate 214 is coupled to a shuttle 240 of the slide mount 202 and the slide mount 202 is coupled to extensions 244 of the base 204. During use, the shuttle 240 may slide back and forth along a track of the slide mount 202 (e.g., in direction of arrow 249) to provide for translation of the cradle 200 (and nozzles 144 secured therein) relative to the slide mount 202 and the base 204. In some embodiments, the movement of the cradle 200 is controlled. For example, the slide mount 202 may be a rod-less air slide having a pneumatic piston that drives linear translation of the shuttle 240 on the track of the slide mount 202 (or similar positioning device), and the nozzle position controller 134 (or a similar control device) may control actuation of the pneumatic piston to control the linear movement (or "stroke") of the piston and shuttle 240 (and the cradle 200 and nozzles 144 secured therein). In some embodiments, the shuttle 240 has a stroke distance of about 1, 2, 3, 4, 5, 6, 7, 8, 9, 10 inches or more. Where, for example, the base 204 is coupled to a positioning system that is operable to move the nozzle holder 130 in one or more dimensions (e.g., in X and Y directions), the translation of the cradle 200 (and nozzles 144 secured therein) relative to the base 204 may provide for an additional dimension or amount of movement (e.g., in the Z direction) of the cradle 200 and nozzles 144 secured therein. For example, where the base 204 of the cradle 200 is coupled to the nozzle holder positioning system 132, the nozzle holder positioning system 132 may be operable to move the nozzle holder 130 side-to-side (e.g., in the X direction) and up-and-down (e.g., in the Y direction) to align the three nozzles 144 secured in the cradle 200 with a set of three tubes 104 of the tube bundle 106, and be operable to drive the shuttle 240 forward or backward (e.g., in the Z direction) to move the cradle 200 (and nozzles 144 secured therein) to cause the nozzles 144 to engage or disengage, respectively, the three tubes 104 of the tube bundle 106.

In some embodiments, the cradle 200 is operable to provide for pivoting of the cradle 200 (and nozzles 144 secured therein) relative to the base 204. This may, for example, provide for tilting the nozzles 144 secured by the cradle 200 to provide flexibility in aligning the nozzles 144 with corresponding tubes 104 of the tube bundle 106. This may be helpful, for example, where the plane of the nozzles 144 secured in the cradle 200 does not exactly align with the pattern/arrangement of the tubes 104 of the bundle 106. The tilting may provide an additional level of flexibility in positioning the nozzles 144 relative to the tubes 104. For example, in the illustrated embodiment, each of the ends of the slide mount 202 is mounted to a slide mount plate 250 that is rotatably coupled to the extension 244 of the cradle baseplate 214 by way of pivot pin 252 having a longitudinal axis (or "pivot axis") 254. During use, a locking pin 256 is inserted through a hole 258 of the extension 244, with a distal end of the locking pin 256 engaging one of a plurality of position holes 260 located in the slide mount plate 250. In some embodiments, the locking pin 256 is biased (e.g., by a spring) into an engaged position to facilitate engagement of the locking pin 256 with one of the position holes 256. In this configuration, the installed locking pin 256 acts to fix the position/rotation of the slide mount plate 250 (and the slide mount 202, the cradle 200 and the nozzles 144 secured therein) relative to the extension 244 of the base 204 (and any position system the base 204 is coupled to, such as the nozzle holder position system 132). For example, in the illustrated embodiment of FIGS. 2A-2F and FIGS. 3A-3G, the slide mount plate 250 (and the slide mount 202, the cradle 200 and the nozzles 144) are fixed in a "flat" position having 0 degrees of rotation relative to the extension 244. In such an embodiment, the nozzles 144 may be arranged in a plane having 0 degrees of rotation relative to the base 204 and any position system the base 204 is coupled to, such as nozzle holder position system 132 (e.g., as depicted in FIG. 1A).

In some embodiments, the slide mount plate 250 includes multiple position holes 260 or the like located about the pivot pin 252. For example, the slide mount plate 250 may include position 260 holes located at angles of 0, 45 and 90 degrees about the pivot pin 252. In such an embodiment, the locking pin 256 may be retracted (or "pulled") through the hole 260 of the extension 244 such that the distal end of the locking pin 256 is not engaged with any of the position holes 260 located in the slide mount plate 250, the slide mount plate 250 (and the slide mount 202, the cradle 200 and the nozzles 144) may be rotated (e.g., about the pivot axis 254 defined by the longitudinal axis 254 of the pivot pin 252) to a position where the slide mount plate 250 (and the slide mount 202, the cradle 200 and the nozzles 144) is rotated/angled 0, 45 or 90 degrees relative to the extension 244 (and any position system the base 204 is coupled to, such as nozzle holder position system 132) and (with the locking pin 256 aligned with a corresponding position hole 260 of the slide mount plate 250, the pivot pin 252 may be advanced (or "pushed") through the hole 258 of the extension 244 such that the distal end of the locking pin 256 engages the position hole 260 located in the slide mount plate 250, to effectively fix (or "lock") the slide mount plate 250 (and the slide mount 202, the cradle 200 and the nozzles 144) in a "flat" or "angled" position with a corresponding degree of rotation (e.g., 0, 45 or 90 degrees) relative to the extension 244. In such an embodiment, the nozzles 144 may be arranged in a plane having 0, 45 or 90 degrees of rotation relative to the base 204 and any position system the base 204 is coupled thereto, such as nozzle holder position system 132. Although angles of 0, 45 and 90 degrees are described for the purpose of illustration, embodiments may include any number of holes to provide any number of angles of rotation, such as 0, 15, 30, 45, 60, 75 or 90 degrees of rotation.

Figure 7A:
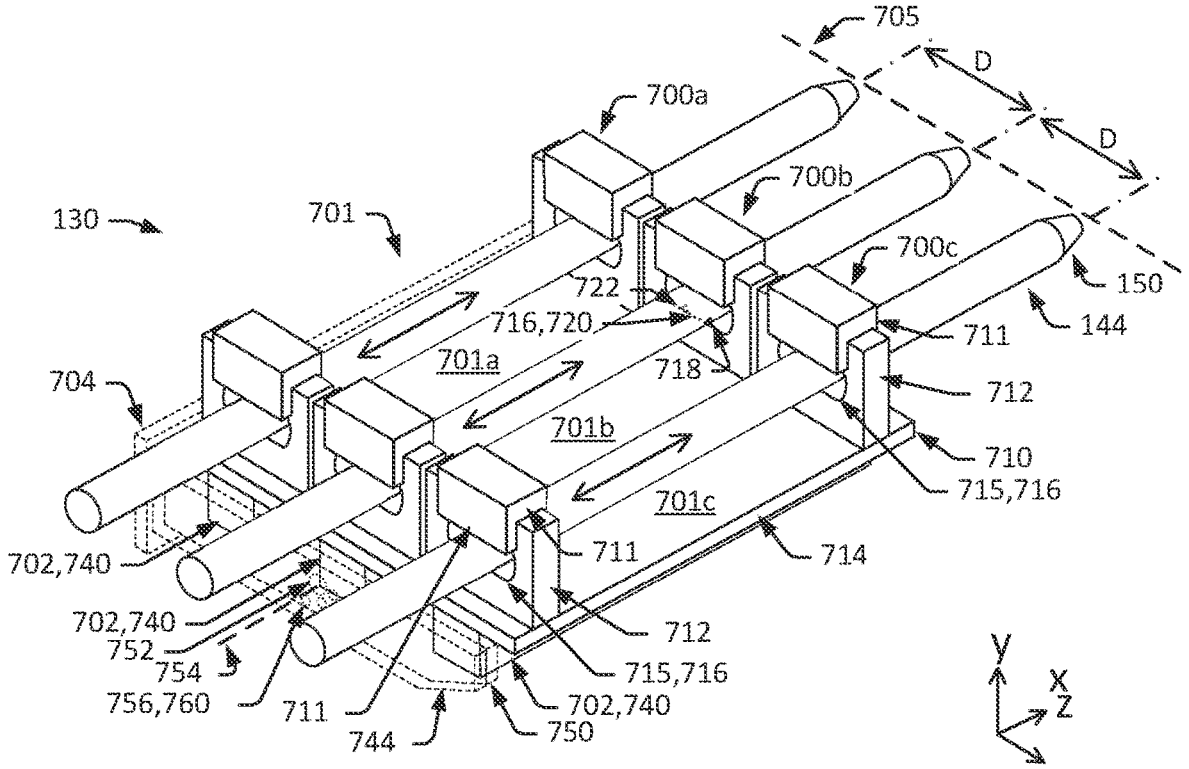
FIGS. 7A and 7B are diagrams that illustrate various views of an example multi-nozzle adapter system in accordance with one or more embodiments.
Figure 7B:
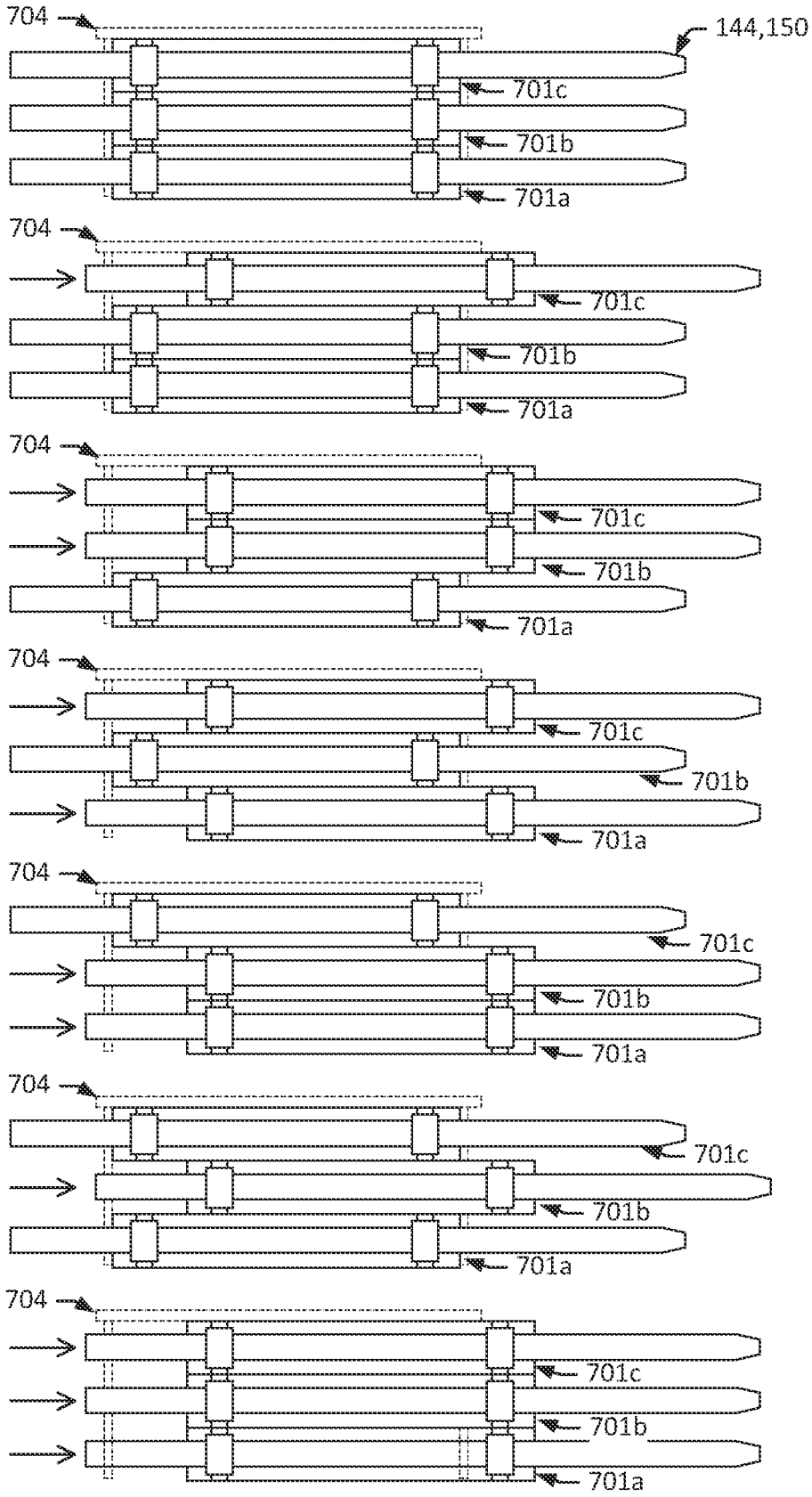

FIGS. 7A and 7B are diagrams that illustrate various views of an example nozzle holder system 130 (an independently movable multi-nozzle holder shown with three nozzles 144 secured therein) in accordance with one or more embodiments. FIG. 7A illustrates a perspective view of the nozzle holder system 130, including three nozzle advancement systems 700 (e.g., including a first, second and third nozzle advancement systems 700*a*, 700*b* and 700*c*). FIG. 7B illustrates top views of the nozzle holder system 130, including the three nozzle advancement systems 700 in different combinations of advancement. As described, in some embodiments, each of the first, second and third nozzle advancement systems 700*a*, 700*b* and 700*c* provide the ability to independently advance or retract the respective cradles 701 and nozzles 144 secured therein. This may be useful, for example, where one or more of the three nozzles 144 is to be extended/engaged (e.g., the nozzle 144 with a tube 104 that has not yet been cleaned for a cleaning operation), and one or more of the other of the three nozzles 144 is to be retracted/disengaged (e.g., the nozzle 144 is aligned with a tube 104 the tube bundle 106 that does not need to be cleaned or cannot be cleaned, or is not aligned with a tube 104). Although a nozzle holder system operable to secure three nozzles is depicted and described for the purpose of illustration, embodiments may include any suitable number and arrangement of nozzles. For example, similar embodiments may include a nozzle holder system 130 operable to secure two, four, five, six, seven, eight, nine, ten or more nozzles 144.

In the illustrated embodiment, each of the three nozzle advancement systems 700 (the first, second and third nozzle advancement systems 700*a*, 700*b* and 700*c*) includes a nozzle holder cradle system (or "nozzle cradle") 701 and a nozzle holder cradle slide mount system (or "slide mount") 702, and is coupled to a nozzle holder base system (or "base") 204. As illustrated, the nozzle holder system 130 is operable to secure three nozzle 144 therein, in a linear arrangement. For example, the three nozzles 144 are secured in place in the nozzle holder system 130 in a planar fashion (e.g., with their longitudinal axes in the same plane) with their outlets 150 aligned linear (e.g., along a line 705) and offset from one another by a given distance (D) (or "pitch" or "spacing").

In the illustrated embodiment, the nozzle cradle 701 includes a nozzle cradle body 710, and nozzle retainers 711. The nozzle cradle body 710 includes cradle ends 712 rigidly coupled to one another by a cradle base plate 714. Each of the cradle ends 712 includes an opening 715 that defines a respective nozzle rest 716. In some embodiments, the opening 715 and nozzle rest 716 of the center cradle 701*b* is relatively narrow in width to capture/retain the nozzle 144 in a given position. In the illustrated embodiment, the opening 715 and the nozzle rest 716 of the center cradle 701*b* is relatively wide and includes two raised portions (or "detents") 718 that define a central portion 720 of the nozzle rest 716 and two side portions 722 of the nozzle rest 716. The central portion 720 may be a recessed surface defined by a portion of the surface of the nozzle rest 716 (or "valley") located between the peaks of the two raised portions (or "detents") 718. The central portion 720 may be operable to capture the body (or "barrel") of a single nozzle 144, where the detents 718 operate to inhibit lateral (e.g., side-to-side) movement of the single nozzle 144 on the nozzle rest 716. The detents 718 may be located relatively close to one another to define a relatively narrow central portion 720 (or "valley") that acts to inhibit lateral movement of the single nozzle 144, such that the single nozzle 144 is "centered" between the detents 718 when disposed on the central portion 720 of the nozzle rest 716.

In the illustrated embodiment, the openings 715 and the nozzle rests 716 of the side cradles 701*a* and 701*c* are relatively wide. The relatively wide openings 715 and the nozzle rests 716 may facilitate adjustment of lateral positioning of the single nozzle 144 in the respective nozzle rest 716. This may enable a single nozzle 144 to be moved into various positions along the surface of the nozzle rest 716. As described, one or more nozzle retainers 711 may be tightened to secure (or "fix") the position of nozzles 144 in each nozzle rest 716.

Although the illustrated and described embodiments includes the center cradle 701*b* having a nozzle rest 716 with detents 718 (or being relatively narrow) to capture/retain the nozzle 144 in a given position, with the side cradles 701*a* and 701*c* having nozzle rests 716 facilitate adjustment of lateral positioning of the single nozzle 144, embodiments may include any suitable arrangement. For example, one or both of the side cradles 701*a* and 701*c* may employ detents (or be relatively narrow) to capture/retain the nozzle 144 in a given position, or the center cradle 701*b* may have a relatively wide nozzle rest 716 to facilitate adjustment of lateral positioning of a nozzle 144 therein.

A cradle 701 with a nozzle rest 716 with detents 718 (or being relatively narrow) may provide for centering of a nozzle 144, while allowing variations/adjustments of the lateral positions of nozzles 144 on either side of the nozzle 144. Such a configuration may provide flexibility in positioning nozzles 144 relative to one another. For example, where it is desirable for the nozzles 144 to have a linear arrangement corresponding to a pitch (e.g., a distance between adjacent nozzles 144 that corresponds to a pitch/distance between adjacent tubes 104 to be engaged by the nozzles 144), a first of the three nozzles 144 may be secured in the valley of the nozzle rest 716 of the center cradle 701*b* (e.g., where it is "centered" within the nozzle rest 716), and each of the other two of the three nozzles 144 may be secured in a respective one of the valleys of the nozzle rests 716 of the side cradles 701*a* and 701*c*, in a position where it is spaced from the first nozzle 144 according to the pitch. For example, where the pitch (D) is a relatively small distance (e.g., 1 inch (in)), the second and third nozzles 144 may each be disposed in the nozzle rests 716 of the side cradles 701*a* and 701*c* such that their longitudinal axis is spaced the small distance (e.g., 1 inch) from the longitudinal axis of the first nozzle 144 disposed in the nozzle rest 716 of the center cradle 701*b*. Where the pitch (D) is a relatively large distance (e.g., 2 inches), the second and third nozzles 144 may each be disposed in the nozzle rests 716 of the side cradles 701*a* and 701*c* such that their longitudinal axis is spaced 2 inches from the longitudinal axis of the first nozzle 144 disposed in the nozzle rest 716 of the center cradle 701*b*.

In some embodiment, each of the nozzle cradle retainers 211 is operable to physically secure one or more of the nozzles 144 into position within a respective one of the nozzle cradles 701. In the illustrated embodiment, each nozzle cradle 701 (e.g., each of nozzle cradle 701*a*, 701*b* and 701*c*) includes two nozzle cradle retainers 711, that are each secured to an upper portion 730 of a respective cradle end 712 by way of a respective threaded retainer adjustment screw 732. During use, the retainer adjustment screw 732 of a retainer 711 may be rotated in a first direction (e.g., clockwise) to draw the retainer 711 downward, such that an underside 734 of the retainer 711 is moved into contact with an upper surface of a nozzle 144 located thereunder, to clamp the nozzle 144 between the underside 734 of the nozzle cradle retainer 711 and the surface of the nozzle rest 716 abutting the nozzle 144 from below. The resulting clamping force may act to secure (or "fix") the nozzle 144 into a position within the nozzle cradle 701. The retainer adjustment screw 732 may be rotated in a second direction (e.g., counterclockwise) to enable the retainer to move upward, to release an associated clamping force acting on one or more nozzles 144 located between the underside 734 of the nozzle cradle retainer 711 and the surface of the nozzle rest 716 abutting the nozzle 144 from below. This may eliminate the clamping force or contact with an upper surface of a nozzle 144 located thereunder, to, for example, facilitate repositioning of the one or more nozzles 144 within the cradle 701 or the removal of the one or more nozzles 144 from the cradle 701.

In some embodiments, each of the nozzle cradles 701 (e.g., each of nozzle cradle 701*a*, 701*b* and 701*c*) (and nozzles 144 secured therein) is operable to translate relative to the base 704. This may, for example, provide for moving the nozzles 144 secured by the cradle 701 forward and backward, into and out of engagement with corresponding tubes 104 of the tube bundle 106. For example, in the illustrated embodiment, each slide mount 702 provides for coupling of a respective nozzle cradle 701 to the base 704, and is operable to provide for translation of the cradle 701 (and the nozzle 144 secured therein) relative to the base 704. In the illustrated embodiment, the cradle baseplate 714 of each nozzle cradle 701 is coupled to a shuttle 740 of a respective slide mount 702 and the slide mount 702 is coupled to extensions 744 of the base 704. During use, the shuttle 740 may slide back and forth along a track of the slide mount 702 (e.g., in direction of arrow 749) to provide for translation of the cradle 701 (and nozzle 144 secured therein) relative to the slide mount 702 and the base 704. In some embodiments, the movement of the cradle 701 is controlled. For example, the slide mount 702 may be a rod-less air slide having a pneumatic piston that drives linear translation of the shuttle 740 on the track of the slide mount 702 (or similar positioning device), and the nozzle position controller 134 (or a similar control device) may control actuation of the pneumatic piston to control the linear movement (or "stroke") of the piston and shuttle 740 (and the cradle 701 and the nozzle 144 secured therein). In some embodiments, the shuttle 740 has a stroke distance of about 1, 2, 3, 4, 5, 6, 7, 8, 9, 10 inches or more. Where, for example, the base 704 is coupled to a positioning system that is operable to move the nozzle holder 130 in one or more dimensions (e.g., in X and Y directions), translation of the cradle 701 (and a nozzle 144 secured therein) relative to the base 704 may provide for an additional dimension or amount of movement (e.g., in the Z direction) of the cradle 701 and nozzles 144 secured therein. For example, where the base 704 is coupled to the nozzle holder positioning system 132, the nozzle holder positioning system 132 may be operable to move the nozzle holder 130 (e.g., including cradles 701*a*, 701*b* and 701*c*) side-to-side (e.g., in the X direction) and up-and-down (e.g., in the Y direction) to align the three nozzles 144 secured in the cradles 701 with a set of three tubes 104 of the tube bundle 106, and be operable to drive the shuttles 740 the cradles 701*a*, 701*b* or 701*c* forward or backward (e.g., in the Z direction) to move the cradles 701*a*, 701*b* or 701*c* (and the nozzles 144 secured therein) to cause the nozzles 144 to engage or disengage, respectively, the three tubes 104 of the tube bundle 106.

In some embodiments, the cradles 701 are independently movable, so that one or more of the cradles 701 (and any nozzles 144 secured therein) can be selectively translated forward or backward. For example, each of the slide mounts 702 may be independently controlled so that each cradle can be moved independent of the other cradles 701. For example, the nozzle position controller 134 may be operable to activate the slide mount 702 coupled to the cradle 701*a* to cause translation (e.g., forward or backward movement) of the cradle 701*a* (and the nozzle 144 secured therein) independent of movement of the other two cradles 701*b* and 701*c*, to activate the slide mount 702 coupled to the cradle 701*b* to cause translation (e.g., forward or backward movement) of the cradle 701*b* (and the nozzle 144 secured therein) independent of movement of the other two cradles 701*a* and 701*c*, and to activate the slide mount 702 coupled to the cradle 701*c* to cause translation (e.g., forward or backward movement) of the cradle 701*c* (and the nozzle 144 secured therein) independent of movement of the other two cradles 701*a* and 701*b*. In some embodiments, the slide mounts 702 may be controlled so that two or more of the cradles 701 move in unison. For example, the nozzle position controller 134 may be operable to activate the slide mounts 702 coupled to the cradles 701*a* and 701*b* to cause translation (e.g., forward or backward movement) of the cradles 701*a* and 701*b* (and the nozzle 144 secured therein) in unison.

FIG. 7B illustrates top views of the nozzle holder system 130 of FIG. 7A, including the three nozzle advancement systems 700 in different combinations of advancement. The diagrams, from top to bottom, illustrate the following: (1) all three of the nozzle advancement systems 700*a*, 700*b* and 700*c* are in a retracted state (e.g., in a disengaged position); (2) a first of the nozzle advancement system 700*c* in an extended state (e.g., in an engaged position) (as indicated by the arrow) and the other two nozzle advancement systems 700*a* and 700*b* in a retracted state; (3) nozzle advancement systems 700*b* and 700*c* in an extended state (as indicated by the arrows) and nozzle advancement system 700*a* a retracted state; (4) nozzle advancement systems 700*a* and 700*c* in an extended state (as indicated by the arrows) and nozzle advancement system 700*b* a retracted state; (5) nozzle advancement systems 700*a* and 700*b* in an extended state (as indicated by the arrows) and nozzle advancement system 700*c* a retracted state; (6) nozzle advancement system 700*b* in an extended state (as indicated by the arrow) and nozzle advancement systems 700*a* and 700*c* a retracted state; and (7) all three of the nozzle advancement systems 700*a*, 700*b* and 700*c* are an extended state (as indicated by the arrows). These views illustrate a level of flexibility provided by the independently movable multi-nozzle holder 130 depicted and described with regard to at least FIG. 7A.

In some embodiments, the nozzle holder 130 of FIG. 7A is operable to provide for pivoting of the cradles 701 (and nozzles 144 secured therein) relative to the base 704. This may, for example, provide for tilting the nozzles 144 secured by the cradles 701 to provide flexibility in aligning the nozzles 144 with corresponding tubes 104 of the tube bundle 106. This may be helpful, for example, where the plane of the nozzles 144 secured in the cradles 701 does not exactly align with the pattern/arrangement of the tubes 104 of the bundle 106. The tilting may provide an additional level of flexibility in positioning the nozzles 144 relative to the tubes 104. For example, in the illustrated embodiment, each of the ends of the slide mounts 702 is mounted to a slide mount plate 750 that is rotatably coupled to an extension 744 of the cradle baseplate 714 by way of pivot pin 752 having a longitudinal axis (or "pivot axis") 754. Similar to that described with regard to the embodiments of FIGS. 2A-3H, during use, a locking pin is inserted through a hole 758 of the extension 744, with a distal end of the locking pin 756 engaging one of a plurality of position holes 760 located in the slide mount plate 750. In some embodiments, the locking pin 756 is biased (e.g., by a spring) into an engaged position to facilitate engagement of the locking pin 756 with one of the position holes 760. In this configuration, the installed locking pin 756 acts to fix the position/rotation of the slide mount plate 750 (and the slide mounts 702, the cradles 701 and the nozzles 144 secured therein) relative to the extension 744 of the base 704 (and any position system the base 704 is coupled to, such as the nozzle holder position system 132). For example, in the illustrated embodiment of FIG. 7A, the slide mount plate 750 (and the slide mounts 702, the cradles 701 and the nozzles 144) are fixed in a "flat" position having 0 degrees of rotation relative to extension 744. In such an embodiment, the nozzles 144 may be arranged in a plane having 0 degrees of rotation relative to the base 704 and any position system the base 704 is coupled to, such as nozzle holder position system 132 (e.g., as depicted in FIG. 1A or FIG. 1B).

In some embodiments, the slide mount plate 750 includes multiple position holes 760 or the like located about the pivot pin 752. For example, the slide mount plate 250 may include position 760 holes located at angles of 0, 45 and 90 degrees about the pivot pin 252. In such an embodiment, the locking pin 756 may be retracted (or "pulled") through the hole 760 of the extension 744 such that the distal end of the locking pin 756 is not engaged with any of the position holes 760 located in the slide mount plate 750, the slide mount plate 750 (and the slide mounts 702, the cradles 701 and the nozzles 144) may be rotated (e.g., about the pivot axis 754 defined by the longitudinal axis 754 of the pivot pin 752) to a position where the slide mount plate 750 (and the slide mounts 702, the cradles 701 and the nozzles 144) is rotated/angled 0, 45 or 90 degrees relative to the extension 744 (and any position system the base 704 is coupled to, such as nozzle holder position system 132) and (with the locking pin 756 aligned with a corresponding position hole 760 of the slide mount plate 750, the pivot pin 752 may be advanced (or "pushed") through the hole 758 of the extension 744 such that the distal end of the locking pin 756 engages the position hole 760 located in the slide mount plate 750, to effectively fix (or "lock") the slide mount plate 750 (and the slide mounts 702, the cradles 701 and the nozzles 144) in a "flat" or "angled" position with a corresponding degree of rotation (e.g., 0, 45 or 90 degrees) relative to the extension 744. In such an embodiment, the nozzles 144 may be arranged in a plane having 0, 45 or 90 degrees of rotation relative to the base 704 and any position system the base 704 is coupled thereto, such as nozzle holder position system 132. Although angles of 0, 45 and 90 degrees are described for the purpose of illustration, embodiments may include any number of holes to provide any number of angles of rotation, such as 0, 15, 30, 45, 60, 75 or 90 degrees of rotation.

In some embodiments, the tube cleaning system 102 comprises a "mobile" nozzle positioning system 110. For example, the mobile nozzle positioning system 110 may include a mobile-type nozzle holder positioning system 132 that provides for moving the nozzle positioning system 110 relative to the tube bundle 106 or a similar item/system to be cleaned. FIGS. 4A-4F (and FIG. 1A) are diagrams that illustrate various views of an example mobile-type nozzle holder positioning system 132 in accordance with one or more embodiments. The nozzle holder positioning system 132 may, for example, be a mobile system that is operable to move and position a nozzle holder 130 (and nozzles 144 secured therein) relative to tubes 104 of the tube bundle 106. In the illustrated embodiment, the nozzle holder positioning system 132 includes a base 302, a vertical elongated member ("vertical member") 304, a lateral elongated member ("lateral member") 306, and a shuttle 308. The nozzle holder 130 (and nozzles 144 secured therein) may be coupled to the shuttle 308 (e.g., as depicted in FIG. 1A). In some embodiments, the shuttle 308 is operable to translate along a length of the lateral elongated member (as illustrated by arrow 311). Such translation of the shuttle 308 may provide for translation of the nozzle holder 130 (and nozzles 144 secured therein) in a dimension (e.g., in the X direction, as illustrated by arrow 311). In some embodiments, the lateral member 306 is pivotably coupled to the vertical member 304 by way of a pivot joint 314 that enables pivoting of the vertical member 304 about a first pivot axis 316 (as illustrated by arrow 318). Pivoting of the vertical member 304 about the first pivot axis 316 may provide for movement of the nozzle holder 130 (and nozzles 144 secured therein) in two dimensions (e.g., X and Y directions). In some embodiments, the lateral member 306 configured to translate along a length of the vertical member 304 (as illustrated by arrow 320). Such translation of the lateral member 306 may provide for translation of the nozzle holder 130 (and nozzles 144 secured therein) in one dimension (e.g., Y direction). In some embodiments, the vertical member 304 is rotatably coupled to the base 302 by way of a rotating connection 322 that enables rotation of the vertical member 304 about a first rotating axis 324 (as illustrated by arrow 326). Such rotation may provide for movement of the nozzle holder 130 (and nozzles 144 secured therein) in two dimensions (e.g., X and Z directions). In some embodiments the base 302 includes a motive system 330 that is operable to provide movement of the positioning system 110 across a surface. For example, the base 302 may include a motive system 330 having a motive device (e.g., a motor or engine) that is operable to drive tracks (or similar devices, such as wheels) to provide movement of the positioning system 110 across the ground or other supporting surface. Movement of the positioning system 110 may provide for movement of the nozzle holder positioning system 132 and the nozzle holder 130 (and nozzles 144 secured therein) in two dimensions (e.g., the X and Y directions) and in some instances a third dimension (e.g., in the Z direction where, for example, the supporting surface has variations in elevation). In some embodiments, positioning of the nozzles 144 relative to tubes 104 of the tube bundle 106 includes "driving" the nozzle holder positioning system 132 into position near the tubes 104 of the tube bundle 106, and moving/rotating the vertical member 304, the lateral member 306, or the shuttle 308 to position the nozzle holder 130 (and nozzles 144 secured therein) proximate the tubes 104 of the tube bundle 106. As described, the cradle 200 may be translated to move the nozzles 144 into and out of engagement with the tubes 104 of the tube bundle 106 (e.g., during a tube bundle cleaning operation). Movement of the nozzle holder positioning system 132 (including the shuttle 240) may be controlled, for example, by the position controller 134.

In some embodiments, the tube cleaning system 102 includes a "fixed" positioning system 110. For example, the positioning system 110 may include a fixed-type nozzle holder positioning system 132 that provides for rigidly securing the nozzle positioning system 110 relative to the tube bundle 106 or a similar item/system to be cleaned. For example, a fixed-type nozzle holder positioning system 132 may rigidly attach to the tube bundle 106 or other hardware located proximate to and fixed relative to the tubes 104. FIG. 1B is a diagram that illustrates an example fixed-type nozzle holder positioning system 132 in accordance with one or more embodiments. In the illustrated embodiment, the nozzle holder positioning system 132 includes a mounting system 170 and a modular positioning system 171, including a first lateral positioning member (or "first horizontal slide") 172, a second lateral positioning member (or "second horizontal slide") 174, a third lateral positioning member (or "vertical slide") 176, lateral shuttles 178, and a vertical shuttle ("nozzle holder shuttle") 180. In the illustrated embodiment, the mounting system 170 includes four rigid members 181 (e.g., flat metal bars) that each have one end secured (e.g., bolted or otherwise fastened) to a periphery (e.g., a bolting flange) of the tube bundle 106 and a second end secured (e.g., bolted or otherwise fastened) to one of the first horizontal slide 172 or the second horizontal slide 174. The vertical slide 176 is slidably coupled to each of the first horizontal slide 172 and the second horizontal slide 174 by way of respective lateral shuttles 178. The nozzle holder shuttle 180 is slidingly engaged with the vertical slide 176. The first horizontal slide 172 and the second horizontal slide 174 are arranged parallel to one another. The vertical slide 176 is arranged transverse (or "perpendicular") to the first horizontal slide 172 and the second horizontal slide 174. The lateral shuttles 178 may be operable to translate (e.g., slide or roll) along a length of the first horizontal slide 172 and the second horizontal slide 174 (as illustrated by arrows 182). The first horizontal slide 172 and the second horizontal slide 174 may include tracks that guide translation of the lateral shuttles 178 there along. The lateral shuttles 178 may include driven shuttles (e.g., including drive motors) that are operable to drive the translation along the first horizontal slide 172 and the second horizontal slide 174. The nozzle holder shuttle 180 may be operable to translate (e.g., slide or roll) along a length of the vertical slide 176 (as illustrated by arrow 184). The vertical slide 176 may include tracks that guide translation of the nozzle holder shuttle 180 there along. The nozzle holder shuttle 180 may include a driven shuttle (e.g., including a drive motor) that is operable to drive the translation along the vertical slide 176. The nozzle holder shuttle 180 includes a nozzle holder mount (e.g., a vertical metal plate) 186 to which the nozzle holder 130 can be mounted. For example, the base 204 of the nozzle holder 130 may be bolted or otherwise fastened to a face of the nozzle holder mount 186.

In some embodiments, the modular positioning system 171 is rigidly mounted to the tube bundle 106 or a similar item/system to be cleaned by way of the mounting system 170. For example, the modular positioning system 171 may be preassembled, a first end of each of the rigid members 181 of the mounting system 170 is secured the tube bundle 106, and the first horizontal slide 172 and the second horizontal slide 174 are each be secured to second ends of respective pairs of the rigid members 181 to rigidly fix a position of the modular positioning system 171 relative to the tube bundle 106 and the inlets 152 of the tubes 104 of the tube bundle 106. The nozzle holder 130 mounted to the nozzle holder shuttle 180 and fluid delivery lines 146 connected to inlets of the nozzles 144. With the modular positioning system 171 mounted (or "installed") to the tube bundle 106, the shuttles 178 and 180 can be used to move the nozzle holder 130 relative to the tubes 104 of the tube bundle 106. For example, the position controller 134 may drive (or otherwise control) the shuttles 178 and 180 to move and position the nozzle holder 130 laterally (e.g., generally normal to a longitudinal axis of one or more of the nozzles 144 secured therein, as illustrated by the X and Y axes of FIG. 1B), and control operation of the slide mount 202 to move and position the nozzle holder 130 (and the nozzles 144 secured therein) longitudinally (e.g., in a direction generally parallel to a longitudinal axis of one or more of the nozzles 144 secured therein, as illustrated by the Z axis of FIG. 1B). As described, the two-dimensional lateral (e.g., side-to-side, up/down) movement may provide for aligning nozzles 144 secured therein with a corresponding set of tubes 104 of the tube bundle 106, and the single dimensional longitudinal (e.g., forward/backward) movement may provide for engagement or disengagement of nozzles 144 with the corresponding set of tubes 104 of the tube bundle 108.

FIGS. 5A-5D are diagrams that illustrate various views of example components of a nozzle system 500 in accordance with one or more embodiments. In the illustrated embodiments, the nozzle system 500 includes a nozzle body 502 and a nozzle tip 504, where the nozzle body 502 and a nozzle tip 504 are mated (e.g., by way of a threaded connection) to form an assembled nozzle system 500. The nozzle body 502 is a tubular member having a cylindrical passage 506, a threaded forward threaded portion 508, and a rearward portion 510 that defines an inlet 512. The nozzle tip 504 is a tubular member having a cylindrical passage 516, a threaded rearward portion 518, and tapered forward portion 520 that defines an outlet 522. When assembled, the inlet 512 defines the inlet of the nozzle system 500, the passages 506 and 516 define a central passage of the nozzle system 500, and the outlet 522 defines the outlet of the nozzle system 500 (see, e.g., FIG. 5D). As described, during an engagement of the nozzle 144 with a tube 104 of the tube bundle (or a similar conduit) the tapered forward portion 520 of the outlet 522 may engage (e.g., be in sealing contact with, contact with, or near contact with) an inlet 152 of the tube 104. The multi-component nature of the nozzle system 500 may enable the nozzle body 502 to be mated with different nozzle tips. For example, where a given nozzle tip 504 is determined to be "worn out," the wrong size/shape for an application, or the like, the given nozzle tip 504 may be removed from the nozzle body 502 and a different nozzle tip 504 may be mated to the nozzle body 502 in its place. In the context of the nozzle body holder 130 described herein, such multi-component nozzle system 500 may enable the replacement/exchange of nozzle tips without having to remove or realign a nozzle within the cradle 200. For example, the nozzle fasteners 211 may be left in a secured position, while the "old" nozzle tip 504 is unscrewed from the nozzle body 502 and a "new" nozzle tip 504 is screwed into the nozzle body 502. This can save time and costs associated with having to remove and reseat a nozzle in the cradle 200.

Figure 6:
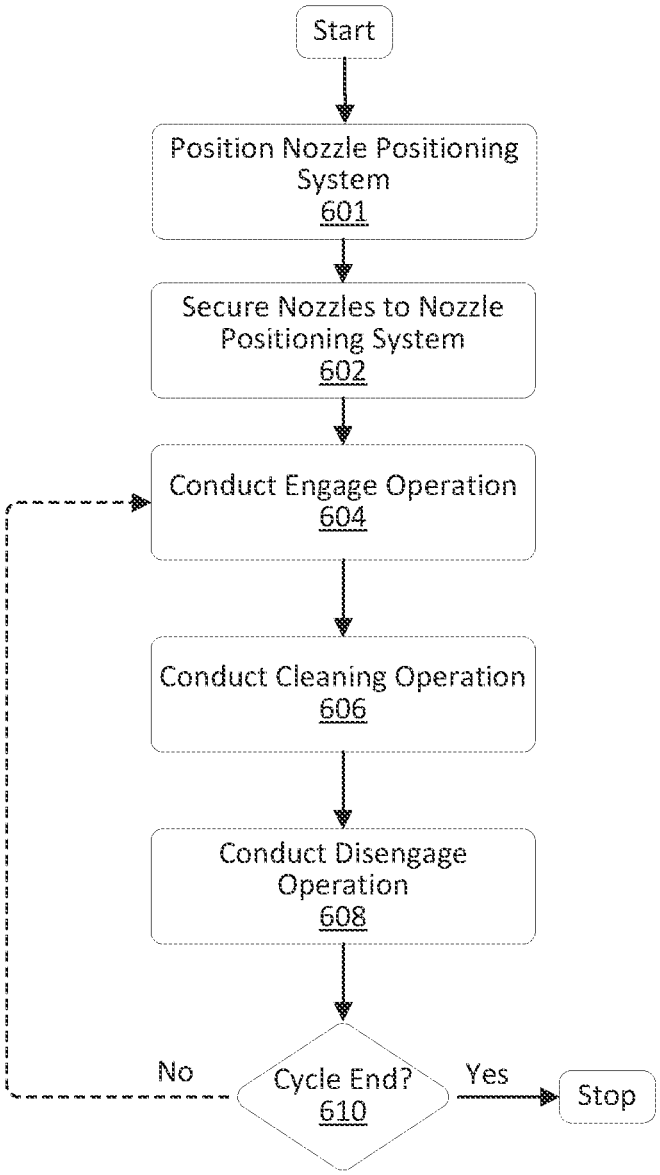
FIG. 6 is a flowchart diagram that illustrates a method in accordance with one or more embodiments.

FIG. 6 is a flowchart diagram that illustrates a method 600 in accordance with one or more embodiments. The method 600 may be employed to clean tubes 104 of tube bundle 106 of a heat exchanger, other conduits of industrial equipment or the like. Some or all of the procedural elements of method 600 may be performed, for example, by the control system 114, the nozzle position controller 134, the fluid source controller 148, an operator (e.g., a person), or another entity. For example, the control system 114 or a person may control operation of the nozzle position controller 134 (or other elements of the positioning system 110) to position the nozzle holder 130 and nozzles 144. The control system 114 or a person may control operation of the fluid source controller 148 (or other elements of the fluid source system 140) to provide fluid flow to the nozzles 144.

In some embodiments, method 600 includes positioning nozzle positioning system (block 601). This may include moving or securing a nozzle positioning system at or near conduit to be cleaned using the nozzle positioning system. For example, where the positioning system 110 employs a mobile-type nozzle holder positioning system 132, positioning the nozzle positioning system 110 may include the nozzle position controller 134 (or other another entity) controlling the motive system 330 to move the mobile-type nozzle holder positioning system 132 to a location proximate the inlets 152 of the tubing 104 of the tube bundle 106, and controlling positioning/rotation of the vertical member 304, the lateral member 306 or the shuttle 308 to move the nozzle holder 130 (and nozzles 144 secured therein) proximate the inlets 152 of the tubing 104 of the tube bundle 106 (e.g., to move outlets 150 of the nozzles 144 within a stroke distance of the slide mount 202 so that the nozzles 144 can be moved into engagement with the tubing 104 to be cleaned by stroking the shuttle 240 (with the cradle 200 and nozzles 144 secured therein)). Where the positioning system 110 employs a fixed-type nozzle holder positioning system 132, positioning the nozzle positioning system 110 may include mounting the modular positioning system 171 to the tube bundle 106 by way of the mounting system 170 to position the nozzle holder 130 and nozzles 144 secured therein proximate the inlets 152 of the tubing 104 of the tube bundle 106 (e.g., to position outlets 150 of the nozzles 144 within a stroke distance of the slide mount 202 so that the nozzles 144 can be moved into engagement with the tubing 104 to be cleaned by stroking the shuttle 240 (with the cradle 200 and nozzles 144 secured therein)).

In some embodiments, method 600 includes securing nozzles to a nozzle positioning system (block 602). This may include securing nozzles to a nozzle positioning system in an arrangement that corresponds to arrangement of conduit to be cleaned using the nozzles. For example, securing nozzles 144 to the nozzle positioning system 110 may include securing the set of three nozzles 144 in the cradle 200 in a nozzle arrangement that corresponds to an arrangement of tubes 104 of the tube bundle 106, as described herein. The arrangement may include, for example, a linear nozzle arrangement with a spacing (or "pitch") of 1 in. In some embodiments, this may also include connecting a respective fluid delivery line 146 between a respective outlet of the fluid source 142 and an inlet of each of the three nozzles 144.

In some embodiments, method 600 includes conducting an engage operation (block 604) This may include conducting a nozzle engage operation that includes operating a nozzle positioning system to advance one or more nozzle assemblies into engagement with one or more conduits to be cleaned using the nozzles. For example, conducting an engage operation may include the nozzle position controller 134 (or other another entity) controlling the nozzle holder positioning system 132 to move the nozzle holder 130 (and nozzles 144 secured therein) laterally (e.g., side-to-side or up/down) to align outlets 150 of the three nozzles 144 with inlets 152 of a first set of three tubes 104 of the tube bundle 106 to be cleaned, and controlling the nozzle holder positioning system 132 to stroke the slide mount 202 of the nozzle holder 130 forward to advance the cradle 200 and the three nozzles 144 secured therein, to move the three nozzles 144 together (as a unit) into simultaneous engagement with the first set of three tubes 104, for the cleaning of the first set of three tubes 104. With regard to an independently movable multi-nozzle holder, such as that described with regard to at least FIGS. 7A and 7B, conducting an engage operation may include the nozzle position controller 134 (or other another entity) controlling the nozzle holder positioning system 132 to move the nozzle holder 130 (and nozzles 144 secured therein) laterally (e.g., side-to-side or up/down) to align the outlet 150 of one or more of the three nozzles 144 with a respective inlet 152 of a tube 104 of the tube bundle 106 to be cleaned, and controlling the nozzle holder positioning system 132 to stroke the respective slide mount(s) 702 (e.g., the slide mount(s) 702 coupled the one or more cradles 701 holding the one or more nozzles 144) forward to advance the one or more nozzles 144 secured therein, into engagement with the tubes 104 to be cleaned. In such an embodiment, if one or more of the nozzles 144 are aligned with a portion of the tube bundle 106 that does not need to be cleaned (e.g., a tube 104 that has already been cleaned, that is sufficiently cleaned, or is plugged/capped, or is not aligned with a tube 104, for example, it is past the end of a row of tubes or is otherwise facing a solid portion the sheet surrounding the tubes 104), it may be determined that the portion is not to be cleaned, and the engage operation may include controlling the nozzle holder positioning system 132 to maintain the nozzle advancement systems 700 securing the nozzle 144 in the retracted/disengaged state. As described, this may provide flexibility to selectively extend/retract individual ones of the nozzles 144 into or out of engagement with tubes, or the like.

In some embodiments, method 600 includes conducting a cleaning operation (block 606). This may include conducting a nozzle cleaning operation that includes flowing cleaning fluid (e.g., including a cleaning/polishing media) through the nozzles (e.g., at a given flowrate, pressure or temperature, or for a given duration), such that the cleaning fluid flows into and through the conduits to clean them. For example, in a first iteration of tube cleaning, conducting a cleaning operation may include the fluid source controller 148 (or other another entity) controlling pumps of the fluid source 142 to pump cleaning fluid (e.g., a fluid including a mixture of water vapor a cleaning media) through the fluid delivery line(s) 146, into and through the three fluid delivery nozzles 144, and into and through the first set of three tubes 104, to polish the tubes 104 to a desired level. With regard to an independently movable multi-nozzle holder, such as that described with regard to at least FIGS. 7A and 7B, in a first iteration of tube cleaning, conducting a cleaning operation may include the fluid source controller 148 (or other another entity) controlling pumps of the fluid source 142 to pump cleaning fluid (e.g., a fluid including a mixture of water vapor a cleaning media) through one or more of the fluid delivery line(s) 146 connected to the one or more fluid delivery nozzles 144 engaged with a tube 104, into and through the one or more fluid delivery nozzles 144 engaged with a tube 104, and into and through the one or more engaged tubes 104, to polish the one or more engaged tubes 104 to a desired level.

The desired level of cleaning/polish may, for example, be verified by way of visual inspection of the interior walls of the tubes 104 after cleaning, measurements of internal diameter of the tubes 104 after cleaning, or the like. In some embodiments, the cleaning operation includes delivering the cleaning fluid a given flowrate, pressure or temperature, for a given duration. For example, the fluid source controller 148 may control the pumps of the fluid source 142 to pump cleaning fluid at a specified flowrate (e.g., in the range of 100-1000 cubic feet hour), a specified pressure (e.g., in the range of 10-200 pounds per square inch(psi)), a specified temperature (e.g., in the range of 0-250 degrees Fahrenheit), for a given length of time (e.g., in the range of 5 seconds to 10 minutes or more). In some embodiments, fluid flow to some or all of the nozzles may be provided or controlled independent of the other nozzles. For example, the fluid source 142 may be capable of providing a stream of cleaning fluid to each of the delivery lines 146 and nozzles 144 connected thereto at a respective set of parameters (e.g., a given combination of flowrate, pressure, temperature, or duration). This may provide flexibility in how cleaning fluid is provided into different conduits of a set of conduits being cleaned. For example, the fluid source controller 148 (or other another entity) may control the pumps of the fluid source 142 to pump cleaning fluid with first, second and third combinations of flowrate, pressure, temperature or duration, into the first, second and third delivery lines 146 and nozzles 144 to provide respective cleaning fluid flows into the respective ones of the first set of three tubes 104.

In some embodiments, method 600 includes conducting a disengage operation (block 608) This may include conducting a nozzle disengage operation that includes operating a nozzle positioning system to retract one or more nozzle assemblies to disengage the one or more conduits previously engaged/cleaned using the nozzles. For example, conducting a disengage operation may include, in response to a determination that the cleaning of the first set of three tubes 104 is complete, the nozzle position controller 134 (or other another entity) controlling the nozzle holder positioning system 132 to stroke the slide mount 202 of the nozzle holder 130 backwards to retract the cradle 200 (and the three nozzles 144 secured therein) to move the three nozzles 144 together (as a unit) out of engagement with the first set of three tubes 104.

In some embodiments, method 600 includes determining whether cleaning cycle should end or continue (block 610). This may include determining whether or not additional conduits are to be cleaned. For example, where the tube bundle includes 33 tubes 104, after a first iteration of cleaning the first set of three tubes 104, the control system 114 (or other another entity) may determine that 30 tubes require cleaning, and may return to conducting a cleaning operation for a next/second set of three tubes 104 to be cleaned. This may include cycling to a next iteration of cleaning a set of three tubes 104, including returning to conducting a nozzle engage operation (block 604), a tube cleanse operation (block 606) and a nozzle disengage operation (block 608) for the next/second set of three tubes 104. For example, the control system 114 (or other another entity) may determine that a next set of next/second set of three tubes 104 located immediately adjacent the first set of three tubes is next to be cleaned, control the nozzle position controller 134 to control the nozzle holder positioning system 132 to move the nozzle holder 130 (and nozzles 144 secured therein) laterally by three times the pitch (e.g., sideways 3 inches) to align outlets 150 of the three nozzles 144 with inlets 152 of the next/second set of three tubes 104 of the tube bundle 106 to be cleaned, and control the nozzle holder positioning system 132 to stroke the slide mount 202 of the nozzle holder 130 forward to advance the cradle 200 (and the three nozzles 144 secured therein) to move the three nozzles 144 together (as a unit) into simultaneous engagement with the next/second set of three tubes 104, for the cleaning of the second set of three tubes 104, and control the fluid source controller 148 control the pumps of the fluid source 142 to pump cleaning fluid at the specified flowrate, pressure or temperature, or given duration, to clean the next/second set of three tubes 104, and (e.g., in response to a determination that the cleaning of the first set of three tubes 104 is complete), control the nozzle position controller 134 to control the nozzle holder positioning system 132 to stroke the slide mount 202 of the nozzle holder 130 backwards to retract the cradle 200 (and the three nozzles 144 secured therein) to move the three nozzles 144 together out of engagement with the next/second set of three tubes 104. The control system 114 (or other another entity) may then return to determining whether cleaning cycle should end or continue (block 610), and determine that 27 tubes still require cleaning, and, as a result, may return to a next iteration of conducting a cleaning operation for a next/third set of three tubes 104 to be cleaned, and so forth until it is determined that there are no more tubes 104 to be cleaned, at which time the cleaning process may be stopped/completed. For example, this may include inspecting the tubes to confirm that a desired level of cleaning has been achieved and, if so, moving/removing the nozzle positioning system 110 from the tube bundle 106. If it is determined that one or more tube require further cleaning, the cleaning process can be repeated for those tubes 104 prior to moving/removing the nozzle positioning system 110 from the tube bundle 106.

Figure 8:
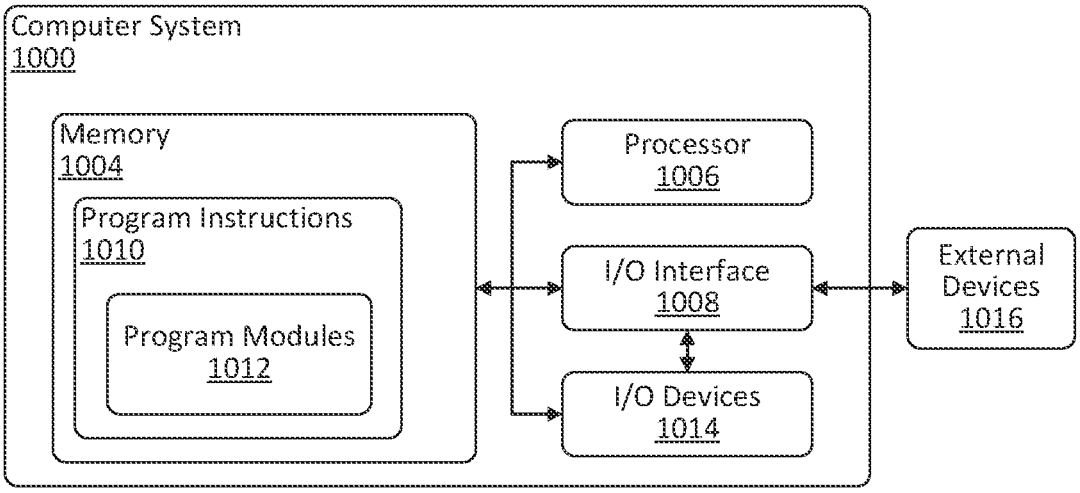
FIG. 8 is a diagram that illustrates an example computer system in accordance with one or more embodiments.

FIG. 8 is a diagram that illustrates an example computer system (or "system") 1000 in accordance with one or more embodiments. The system 1000 may include a memory

1004, a processor 1006 and an input/output (I/O) interface 1008. The memory 1004 may include non-volatile memory (e.g., flash memory, read-only memory (ROM), programmable read-only memory (PROM), erasable programmable read-only memory (EPROM), electrically erasable programmable read-only memory (EEPROM)), volatile memory (e.g., random access memory (RAM), static random-access memory (SRAM), synchronous dynamic RAM (SDRAM)), or bulk storage memory (e.g., CD-ROM or DVD-ROM, hard drives). The memory 1004 may include a non-transitory computer-readable storage medium having program instructions 1010 stored on the medium. The program instructions 1010 may include program modules 1012 that are executable by a computer processor (e.g., the processor 1006) to cause the functional operations described, such as those described with regard to the entities described (e.g., controller system 114, nozzle position controller 134, fluid source controller 148, an operator, or other entity), or method 600.

The processor 1006 may be any suitable processor capable of executing program instructions. The processor 1006 may include one or more processors that carry out program instructions (e.g., the program instructions of the program modules 1012) to perform the arithmetical, logical, or input/output operations described. The processor 1006 may include multiple processors that can be grouped into one or more processing cores that each include a group of one or more processors that are used for executing the processing described here, such as the independent parallel processing of partitions (or "sectors") by different processing cores to generate a simulation of a reservoir. The I/O interface 1008 may provide an interface for communication with one or more I/O devices 1014, such as a joystick, a computer mouse, a keyboard, or a display screen (e.g., an electronic display for displaying a graphical user interface (GUI)). The I/O devices 1014 may include one or more of the user input devices. The I/O devices 1014 may be connected to the I/O interface 1008 by way of a wired connection (e.g., an Industrial Ethernet connection) or a wireless connection (e.g., a Wi-Fi connection). The I/O interface 1008 may provide an interface for communication with one or more external devices 1016, computer systems, servers or electronic communication networks. In some embodiments, the I/O interface 1008 includes an antenna or a transceiver.

Further modifications and alternative embodiments of various aspects of the disclosure will be apparent to those skilled in the art in view of this description. Accordingly, this description is to be construed as illustrative only and is for the purpose of teaching those skilled in the art the general manner of carrying out the embodiments. It is to be understood that the forms of the embodiments shown and described here are to be taken as examples of embodiments. Elements and materials may be substituted for those illustrated and described here, parts and processes may be reversed or omitted, and certain features of the embodiments may be utilized independently, all as would be apparent to one skilled in the art after having the benefit of this description of the embodiments. Changes may be made in the elements described here without departing from the spirit and scope of the embodiments as described in the following claims. Headings used here are for organizational purposes only and are not meant to be used to limit the scope of the description.

It will be appreciated that the processes and methods described here are example embodiments of processes and methods that may be employed in accordance with the techniques described here. The processes and methods may be modified to facilitate variations of their implementation and use. The order of the processes and methods and the operations provided may be changed, and various elements may be added, reordered, combined, omitted, modified, and so forth. Portions of the processes and methods may be implemented in software, hardware, or a combination thereof. Some or all of the portions of the processes and methods may be implemented by one or more of the processors/modules/applications described here.

Throughout this application, the word "may" is used in a permissive sense (meaning having the potential to), rather than the mandatory sense (meaning must). The words "include," "including," and "includes" mean including, but not limited to. As used throughout this application, the singular forms "a," "an," and "the" include plural referents unless the content clearly indicates otherwise. Thus, for example, reference to "an element" may include a combination of two or more elements. As used throughout this application, the term "or" is used in an inclusive sense, unless indicated otherwise. That is, a description of an element including A or B may refer to the element including one or both of A and B. As used throughout this application, the phrase "based on" does not limit the associated operation to being solely based on a particular item. Thus, for example, processing "based on" data A may include processing based at least in part on data A and based at least in part on data B, unless the content clearly indicates otherwise. As used throughout this application, the term "from" does not limit the associated operation to being directly from. Thus, for example, receiving an item "from" an entity may include receiving an item directly from the entity or indirectly from the entity (e.g., by way of an intermediary entity). Unless specifically stated otherwise, as apparent from the discussion, it is appreciated that throughout this specification discussions utilizing terms such as "processing," "computing," "calculating," "determining," or the like refer to actions or processes of a specific apparatus, such as a special purpose computer or a similar special purpose electronic processing/computing device. In the context of this specification, a special purpose computer or a similar special purpose electronic processing/computing device is capable of manipulating or transforming signals, typically represented as physical, electronic or magnetic quantities within memories, registers, or other information storage devices, transmission devices, or display devices of the special purpose computer or similar special purpose electronic processing/computing device.

In this patent, to the extent any U.S. patents, U.S. patent applications, or other materials (e.g., articles) have been incorporated by reference, the text of such materials is only incorporated by reference to the extent that no conflict exists between such material and the statements and drawings set forth herein. In the event of such conflict, the text of the present document governs, and terms in this document should not be given a narrower reading in virtue of the way in which those terms are used in other materials incorporated by reference.

The present techniques will be better understood with reference to the following enumerated embodiments:

1. A tube cleaning system (100) comprising:
   a nozzle positioning system (102) configured to provide for engagement of a plurality of nozzles (104) with a plurality of tubes (106) of a tube bundle (108).

2. The system of embodiment 1, further comprising a multi-nozzle adapter (110) configured to secure the multiple nozzles in position to engage the multiple tubes of the tube bundle.

3. The system of embodiment 1 or embodiment 2, further comprising a mobile positioning system (120).

4. The system of any one of embodiments 1-3, further comprising a controller (130, 132) configured to control positioning of the plurality of nozzles.

5. The system of any one of embodiments 1-4, further comprising a controller (130, 134) configured to control flow of fluid (136) through the nozzles.

6. A system, comprising:
- a multi-nozzle adapter system (110) comprising:
  - an adapter baseplate (200) configured to couple to a nozzle positioning system (102,120);
  - an adapter nozzle holder system (202) comprising:
    - a holder body (204) coupled to the adapter baseplate; and
    - a holder retainer (206),
  - the holder retainer configured to secure a plurality of nozzle assemblies (104) against the holder body in a nozzle arrangement; and
  - the adapter nozzle holder system configured to translate (arrow 208) relative to the adapter baseplate.

7. The system of embodiment 6, wherein the nozzle arrangement comprises two or more nozzles spaced according to a pitch corresponding to a spacing of tubes of a tube bundle.

8. The system of embodiment 6 or embodiment 7, wherein the holder body or the adapter nozzle holder comprises one or more detents (210) configured to provide for positioning of at least one of the nozzle assemblies against the holder body.

9. The system of any one of embodiments 6-8, wherein the nozzle arrangement comprises three or more nozzles in parallel-planer arrangement.

10. The system of any one of embodiment 6-9, wherein translation of the adapter nozzle holder system in a first direction relative to the adapter baseplate is configured to provide for engagement of the nozzle assemblies with tubes of a tube bundle, and translation of the adapter nozzle holder system in a second direction relative to the adapter baseplate is configured to provide for disengagement of the nozzle assemblies from the tubes of the tube bundle.

11. The system of any one of embodiment 6-10, wherein multi-nozzle adapter system comprises a slide mount (212), wherein the adapter baseplate is coupled to the holder body by way of the slide mount, and wherein the slide mount provides for translation of the adapter nozzle holder system relative to the adapter baseplate.

12. The system of embodiment 11, wherein the slide mount comprises a rod-less air slide.

13. The system of any one of embodiments 6-12, wherein the adapter nozzle holder is configured to pivot (arrow 214) relative to the adapter baseplate.

14. The system of any one of embodiments 6-13, wherein the positioning system is configured to provide for positioning of the multi-nozzle adapter system in two dimensions, and wherein the translation of the adapter nozzle holder system relative to the adapter baseplate provides for positioning of the adapter nozzle holder system in a third dimension.

15. The system of any one of embodiments 6-14, further comprising the positioning system.

16. The system of any one of embodiments 6-15, further comprising a controller configured to control positioning of the multi-nozzle adapter system.

17. The system of any one of embodiments 6-16, further comprising a controller configured to control flow of fluid through the plurality of nozzle assemblies.

18. A nozzle positioning system comprising:
- a base (302);
- a vertical elongated member (304);
- a lateral elongated member (306); and
- a shuttle (308) configured to couple to a multi-nozzle adapter system,
- the shuttle (310) configured to translate along a length of the lateral elongated member,
- the lateral member pivotably (arrow 312) coupled to the vertical elongated member,
- the lateral member configured to translate (arrow 314) along a length of the vertical elongated member, and
- the vertical elongated member rotatably (arrow 316) coupled to the base.

19. The system of embodiment 18, wherein the positioning system is configured to provide for positioning of the shuttle in three dimensions.

20. The system of embodiment 18 or embodiment 19, wherein the base comprises a motive system configured to provide for movement of the positioning system across a surface.

21. A method of cleaning tubes, the method comprising:
- engaging multiple nozzles with multiple tubes of a tube bundle.

22. The method of embodiment 21, the method further comprising:
- flowing cleaning fluid through the nozzles into the plurality of tubes of the tube bundle.

23. A method comprising:
- securing a plurality of nozzle assemblies in a multi-nozzle adapter system of a nozzle positioning system (602);
- conducting an engage operation (604) comprising controlling the nozzle positioning system to advance the plurality of nozzle assemblies into engagement with a plurality of tubes of a tube bundle;
- conducting a cleanse operation (606) comprising flowing cleaning media through the nozzle assemblies at a given flowrate, pressure and temperature for a given duration, such that the media flows into the plurality of tubes of the tube bundle;
- and conducting a disengage operation (608) comprising controlling the nozzle positioning system to retract the plurality of nozzle assemblies to disengage the plurality of tubes of the tube bundle.

24. The method of embodiment 23, further comprising:
- conducting a second engage operation (610) comprising controlling the nozzle positioning system to advance the plurality of nozzle assemblies into engagement with a second plurality of tubes of the tube bundle;
- conducting a second cleanse operation comprising flowing cleaning media through the nozzles at a second given flowrate, pressure and temperature for a second given duration, such that the media flows into the second plurality of tubes of the tube bundle; and
- conducting a second disengage operation comprising controlling the nozzle positioning system to retract the plurality of nozzle assemblies to disengage the second plurality of tubes of the tube bundle.

25. The method of embodiment 23 or embodiment 24, wherein the multi-nozzle adapter system comprises:
- an adapter baseplate configured to couple to a nozzle positioning system;
- an adapter nozzle holder system comprising:
  - a holder body coupled to the adapter baseplate; and
  - a holder retainer, wherein securing the plurality of nozzle assemblies in the multi-nozzle adapter system comprises securing the plurality of nozzle assemblies against the holder body in a nozzle arrangement using the holder retainer.

26. The method of any one of embodiments 23-25, wherein the advancement of the plurality of nozzle assemblies into engagement with the plurality of tubes of the tube bundle comprises forward translation of the adapter nozzle holder system relative to the adapter baseplate, and wherein the retraction of the plurality of nozzle assemblies to disengage the plurality of tubes of the tube bundle comprises rearward translation of the adapter nozzle holder system relative to the adapter baseplate.

27. The method of any one of embodiments 23-26, wherein the cleanse operation comprises a vapor blast cleanse operation comprising flowing a mixture of water vapor and the media through the nozzle assemblies at the given flowrate, pressure and temperature for the given duration, such that the mixture of the water vapor and the media flows into the plurality of tubes of the tube bundle.

28. A non-transitory computer readable storage medium comprising program instructions stored thereon that are executable by a processor to perform the method operations of any one of embodiments 21-27.

1A. A heat exchanger tube bundle cleaning system comprising:

a nozzle positioning system comprising:

a nozzle holder configured to secure nozzles in a nozzle arrangement, the nozzle arrangement corresponding to an arrangement of tubes of a tube bundle;

a nozzle holder positioning system configured to move the nozzle holder and the nozzles secured therein relative to the tube bundle; and a nozzle position controller configured to control the nozzle holder positioning system to move the nozzles into engagement with tubes of the tube bundle such that the nozzles are positioned to direct a cleaning fluid into the tubes of the tube bundle engaged by the nozzles.

2A. The system of embodiment 1A, the nozzle holder comprising:

a nozzle cradle; and one or more nozzle retainers, wherein the one or more nozzle retainers are configured to secure the nozzles in the nozzle cradle in the nozzle arrangement.

3A. The system of embodiment 2A, wherein the one or more nozzle retainers are configured to hold the nozzles against the nozzle cradle to secure the nozzles in the nozzle arrangement.

4A. The system of any one of embodiments 1A-3A, wherein the nozzle holder is configured to provide for variability of positioning of the nozzles in the nozzle holder to enable securing the nozzles in a second nozzle arrangement.

5A. The system of any one of embodiments 1A-4A, wherein the nozzle holder is configured position at least one nozzle of the nozzles in a given position, and wherein the nozzle holder is configured to enable variability of the position of at least one nozzle of the nozzles.

6A. The system of embodiment 5A, wherein the nozzles comprise three nozzles, wherein the nozzle holder is configured to position a first nozzle of the nozzles in a given position, wherein the nozzle holder is configured to enable variability of the lateral positioning of a second nozzle of the nozzles to a first side of the given position, and wherein the nozzle holder is configured to enable variability of the lateral positioning of a third nozzle of the nozzles to a second side of the given position.

7A. The system of any one of embodiments 1A-6A, wherein the arrangement of tubes of the tube bundle comprises a given tube spacing, and wherein the nozzle arrangement comprises a nozzle spacing corresponding to the given tube spacing.

8A. The system of any one of embodiments 1A-7A, wherein the nozzle arrangement is a linear arrangement comprising outlets of the nozzles aligned linearly and offset by a given distance.

9A. The system of any one of embodiments 1A-8A, wherein the nozzle holder comprises:

a nozzle holder base configured to couple to a shuttle of the nozzle positioning system; and a nozzle holder cradle configured to secure the plurality of nozzles in a nozzle arrangement, wherein the nozzle cradle is configured to translate relative to the nozzle holder base to provide for movement of the nozzle holder cradle and the nozzles secured in the nozzle holder cradle relative to the shuttle of the nozzle positioning system.

10A. The system of embodiment 9A, wherein the positioning system is configured to provide for moving the shuttle, nozzle holder and nozzles secured in the nozzle holder in two dimensions, and wherein the translation of the nozzle holder cradle is configured to provide for moving the nozzle holder and nozzles secured in the nozzle holder cradle in a third dimension.

11A. The system of embodiment 9A or embodiment 10A, wherein the nozzle holder cradle is configured to pivot relative to the nozzle holder base to provide for pivoting of the cradle and the nozzles secured in the nozzle holder cradle relative to the shuttle of the nozzle positioning system.

12A. The system of any one of embodiments 1A-11A, wherein the nozzle holder comprises a multi-nozzle holder configured to provide for independent movement of the nozzles relative to one another, and wherein the nozzle position controller is configured to control the nozzle holder positioning system to move a first nozzle of the nozzles into engagement with a tube of the tube bundle and position a second nozzle of the nozzles in a disengaged state.

13A. A method of cleaning tubes of a tube bundle comprising:

securing nozzles in a nozzle holder of a nozzle positioning system in a nozzle arrangement corresponding to an arrangement of tubes of a tube bundle;

conducting a tube engage operation comprising controlling the nozzle holder positioning system to move the nozzle holder to advance the nozzles into engagement with a set of tubes of the tube bundle;

conducting a tube cleaning operation comprising directing cleaning fluid into the set of tubes by way of the nozzles engaged with the set of tubes;

conducting a tube disengage operation comprising controlling the nozzle holder positioning system to retract the nozzles to disengage the set of tubes of the tube bundle.

14A. The method of embodiment 13A, further comprising:

conducting a second tube engage operation comprising controlling the nozzle holder positioning system to advance the nozzles into engagement with a second set of tubes of the tube bundle;

conducting a second tube cleaning operation comprising directing cleaning fluid into the second set of tubes by way of the nozzles; and conducting a second tube disengage operation comprising controlling the nozzle holder positioning system to retract the nozzles to disengage the second set of tubes of the tube bundle.

15A. The method of embodiment 13A or embodiment 14A, the nozzle holder comprising:

a nozzle cradle; and one or more nozzle retainers, wherein the one or more nozzle retainers are configured to secure the nozzles in the nozzle cradle in the nozzle arrangement, and wherein securing the nozzles in the nozzle holder comprises securing the nozzles in the nozzle holder using the one or more nozzle retainers.

16A. The method of embodiment 15A, wherein the one or more nozzle retainers hold the nozzles against the nozzle cradle to secure the nozzles in the nozzle arrangement.

17A. The method of any one of embodiments 13A-16A, the method further comprising:

adjusting positioning of the nozzles in the nozzle holder to dispose the nozzles in a second nozzle arrangement corresponding to a second arrangement of a second set of tubes of a tube bundle;

securing the nozzles in the nozzle holder in the second nozzle arrangement;

conducting a second tube engage operation comprising controlling the nozzle holder positioning system to advance the nozzles secured in the second nozzle arrangement into engagement with the second set of tubes of the tube bundle;

conducting a second tube cleaning operation comprising directing cleaning fluid into the second set of tubes by way of the nozzles secured in the second nozzle arrangement; and conducting a second tube disengage operation comprising controlling the nozzle holder positioning system to retract the nozzles secured in the second nozzle arrangement to disengage the second set of tubes of the tube bundle.

18A. The method of any one of embodiments 13A-17A, wherein the nozzle holder is configured position at least one nozzle of the nozzles in a given position, wherein the nozzle holder is configured to enable variability of the position of at least one nozzle of the nozzles, wherein securing the nozzles in the nozzle holder comprises securing a first nozzle in the given position and securing a second nozzle in a position relative to the given position, wherein the position relative to the given position corresponds to the arrangement of tubes of the tube bundle.

19A. The method of embodiment 18A, wherein the nozzles comprise three nozzles, wherein the nozzle holder is configured to position a first nozzle of the nozzles in a given position, wherein the nozzle holder is configured to enable variability of lateral positioning of a second nozzle of the nozzles to a first side of the given position, and wherein the nozzle holder is configured to enable variability of lateral positioning of a third nozzle of the nozzles to a second side of the given position, wherein securing the nozzles in the nozzle holder comprises securing the first nozzle in the given position, securing the second nozzle in a second position offset from the given position by a distance corresponding to the arrangement of tubes of the tube bundle, and securing the third nozzle in a third position offset from the given position by a distance corresponding to the arrangement of tubes of the tube bundle.

20A. The method of any one of embodiments 13A-19A, wherein the arrangement of tubes of the tube bundle comprises a given tube spacing, and wherein the nozzle arrangement comprises a nozzle spacing corresponding to the given tube spacing.

21A. The method of any one of embodiment 13A-20A, wherein the nozzle arrangement is a linear arrangement comprising outlets of the nozzles aligned linearly and offset by a given distance.

22A. The method of any one of embodiment 13A-21A, wherein the nozzle holder comprises:

a nozzle holder base configured to couple to a shuttle of the nozzle positioning system; and a nozzle holder cradle configured to secure the plurality of nozzles in a nozzle arrangement, wherein the nozzle cradle is configured to translate relative to the nozzle holder base to provide for movement of the nozzle holder cradle and the nozzles secured in the nozzle holder cradle relative to the shuttle of the nozzle positioning system, the tube engage operation comprising controlling the nozzle holder positioning system to translate the nozzle cradle forward relative to the nozzle holder base to advance the nozzles into engagement with the set of tubes of the tube bundle, and the tube disengage operation comprising controlling the nozzle holder positioning system to translate the nozzle cradle backwards relative to the nozzle holder base to retract the nozzles to disengage engage the set of tubes of the tube bundle.

23A. The method of embodiment 22A, wherein the positioning system is configured to provide for moving the shuttle, nozzle holder and nozzles secured in the nozzle holder in two dimensions, and wherein the translation of the nozzle holder cradle is configured to provide for moving of the nozzle holder and nozzles secured in the nozzle holder cradle in a third dimension, the tube engage operation comprising:

controlling the nozzle holder positioning system to align the nozzles with the set of tubes of the tube bundle; and controlling the nozzle holder positioning system to translate the nozzle cradle forward relative to the nozzle holder base advance the nozzles into engagement with the set of tubes of the tube bundle.

24A. The method of embodiment 22A or 23A, wherein the nozzle holder cradle is configured to pivot relative to the nozzle holder base to provide for pivoting of the cradle and the nozzles relative to the shuttle of the nozzle positioning system, wherein securing nozzles in a nozzle holder of a nozzle positioning system in a nozzle arrangement comprises pivoting the nozzle holder cradle to pivot the nozzles into a position corresponding to the arrangement of the tubes of the tube bundle.

25A. The method of any one of embodiment 13A-24A, wherein the tube cleaning operation comprises a vapor blast cleaning operation, and directing cleaning fluid into the set of tubes by way of the nozzles comprises flowing a mixture of water vapor and media through the nozzles at a given flowrate for a given duration.

26A. The method of any one of embodiments 13A-25A, wherein the nozzle holder comprises a multi-nozzle holder configured to provide for independent movement of the nozzles relative to one another, and the method comprising conducting a tube engage operation comprising controlling the nozzle holder positioning system to move a first nozzle of the nozzles into engagement with a tube of the tube bundle and position a second nozzle of the nozzles in a disengaged state.

27A. A non-transitory computer readable storage medium comprising program instructions stored thereon that are executable by a processor to perform the following operations for cleaning tubes of a tube bundle comprising:

controlling a nozzle holder positioning system to conduct a tube engage operation comprising moving a nozzle holder to advance nozzles into engagement with a set of tubes of a tube bundle, the nozzles secured in the nozzle holder in a nozzle arrangement corresponding to an arrangement of tubes of the tube bundle;

conducting a tube cleaning operation comprising directing cleaning fluid into the set of tubes by way of the nozzles engaged with the set of tubes; and conducting a tube disengage operation comprising controlling the nozzle holder positioning system to retract the nozzles to disengage the set of tubes of the tube bundle.

28A. A tube cleaning system comprising:

a nozzle holder configured to secure nozzles in a nozzle arrangement, the nozzle arrangement corresponding to an arrangement of tubes of a tube bundle; and a nozzle positioning system configured to move the nozzle holder to cause the nozzles to engage a set of tubes of the tubes of the tube bundle, the nozzles configured to direct cleaning fluid into the set of tubes.

29A. A non-transitory computer readable storage medium comprising program instructions stored thereon that are executable by a processor to perform the method operations of any one of embodiments 13A-26A.

What is claimed is:

1. A vapor blast heat exchanger tube bundle cleaning system comprising:

a nozzle positioning system comprising:

a nozzle holder configured to secure nozzles in a nozzle arrangement, the nozzle arrangement corresponding to an arrangement of tubes of a tube bundle;

a nozzle holder positioning system configured to move the nozzle holder and the nozzles secured therein relative to the tube bundle in a first dimension, a second dimension, and a third dimension; and a nozzle position controller configured to control the nozzle holder positioning system to move the nozzles in the third dimension to position outlets of the nozzles into engagement with inlets of the tubes of the tube bundle such that the nozzles are positioned to direct a cleaning fluid comprising a mixture of water vapor and media into the inlets of the tubes of the tube bundle while the inlets of the tubes of the tube bundle are engaged by the outlets of the nozzles to provide a vapor blast cleanse of the tubes of the tube bundle.

2. The system of claim 1, the nozzle holder comprising:

a nozzle cradle; and one or more nozzle retainers, wherein the one or more nozzle retainers are configured to secure the nozzles in the nozzle cradle in the nozzle arrangement.

3. The system of claim 2, wherein the one or more nozzle retainers are configured to hold the nozzles against the nozzle cradle to secure the nozzles in the nozzle arrangement.

4. The system of claim 1, wherein the nozzle holder is configured to provide for variability of positioning of the nozzles in the nozzle holder to enable securing the nozzles in a second nozzle arrangement.

5. The system of claim 1, wherein the nozzle holder is configured to position at least one nozzle of the nozzles in a given position, and wherein the nozzle holder is configured to enable variability of the position of at least one nozzle of the nozzles.

6. The system of claim 5, wherein the nozzles comprise three nozzles, wherein the nozzle holder is configured to position a first nozzle of the nozzles in a given position, wherein the nozzle holder is configured to enable variability of lateral positioning of a second nozzle of the nozzles to a first side of the given position, and wherein the nozzle holder is configured to enable variability of lateral positioning of a third nozzle of the nozzles to a second side of the given position.

7. The system of claim 1, wherein the arrangement of tubes of the tube bundle comprises a given tube spacing, and wherein the nozzle arrangement comprises a nozzle spacing corresponding to the given tube spacing.

8. The system of claim 1, wherein the nozzle arrangement is a linear arrangement comprising outlets of the nozzles aligned linearly and offset by a given distance.

9. The system of claim 1, wherein the nozzle holder comprises:

a nozzle holder base configured to couple to a shuttle of the nozzle positioning system; and a nozzle holder cradle comprising nozzle retainers configured to engage an exterior of the nozzles to secure the nozzles in the nozzle arrangement, wherein the nozzle cradle is configured to translate relative to the nozzle holder base to provide for movement of the nozzle holder cradle, the nozzle retainers and the nozzles secured in the nozzle holder cradle in the third dimension relative to the shuttle of the nozzle positioning system to position the outlets of the nozzles into engagement with the inlets of the tubes of the tube bundle.

10. The system of claim 9, wherein the nozzle holder cradle is coupled to the nozzle holder base by way of a slide mount configured to provide for sliding translation of the nozzle cradle in the third dimension relative to the nozzle holder base.

11. The system of claim 9, wherein the nozzle holder cradle is configured to pivot relative to the nozzle holder base about a pivot axis extending in the third dimension to provide for pivoting of the cradle and the nozzles secured in the nozzle holder cradle relative to the shuttle of the nozzle positioning system.

12. The system of claim 1, wherein the nozzle holder comprises a multi-nozzle holder configured to provide for independent movement of the nozzles relative to one another, and wherein the nozzle position controller is configured to control the nozzle holder positioning system to move a first nozzle of the nozzles into engagement with a tube of the tube bundle and position a second nozzle of the nozzles in a disengaged state.

13. The system of claim 1, wherein the outlets of the nozzles are configured to be positioned into sealing engagement, contact engagement or near contact engagement with inlets of the tubes of the tube bundle to direct the cleaning fluid into the inlets of the tubes of the tube bundle while the inlets of the tubes of the tube bundle are engaged by the outlets of the nozzles.

14. A method of vapor blast cleaning tubes of a tube bundle comprising:

securing nozzles in a nozzle holder of a nozzle positioning system in a nozzle arrangement corresponding to an arrangement of tubes of a tube bundle, a nozzle holder positioning system configured to move the nozzle holder and the nozzles secured therein relative to the tube bundle in a first dimension, a second dimension, and a third dimension to position outlets of the nozzles into engagement with inlets of tubes of the tube bundle such that the nozzles are positioned to direct a cleaning fluid comprising a mixture of water vapor and media into the inlets of the tubes of the tube bundle while the inlets of the tubes of the tube bundle are engaged by the outlets of the nozzles to provide a vapor blast cleanse of the tubes of the tube bundle;

conducting a tube engage operation comprising controlling the nozzle holder positioning system to move the nozzle holder in the third dimension to advance the outlets of the nozzles into engagement with inlets of a set of tubes of the tube bundle;

conducting a tube cleaning operation comprising directing cleaning fluid comprising a mixture of water vapor and media into the inlets of the set of tubes by way of the outlets of the nozzles engaged with the inlets of the set of tubes of the tube bundle;

conducting a tube disengage operation comprising controlling the nozzle holder positioning system to move the nozzle holder in the third dimension to retract the outlets of the nozzles to disengage the outlets of the nozzles from the inlets of the set of tubes of the tube bundle.

15. The method of claim 14, further comprising:

conducting a second tube engage operation comprising controlling the nozzle holder positioning system to move the nozzle holder in the third dimension to advance the outlets of the nozzles into engagement with inlets of a second set of tubes of the tube bundle;

conducting a second tube cleaning operation comprising directing cleaning fluid comprising a mixture of water vapor and media into the inlets of the second set of tubes by way of the outlets of the nozzles engaged with ends of the second set of tubes; and conducting a second tube disengage operation comprising controlling the nozzle holder positioning system to move the nozzle holder in the third dimension to retract the outlets of the nozzles to disengage the outlets of the nozzles from the inlets of the second set of tubes of the tube bundle.

16. The method of claim 14, the nozzle holder comprising:

a nozzle cradle; and one or more nozzle retainers, wherein the one or more nozzle retainers are configured to secure the nozzles in the nozzle cradle in the nozzle arrangement, and wherein securing the nozzles in the nozzle holder comprises securing the nozzles in the nozzle holder using the one or more nozzle retainers.

17. The method of claim 16, wherein the one or more nozzle retainers hold the nozzles against the nozzle cradle to secure the nozzles in the nozzle arrangement.

18. The method of claim 14, the method further comprising:

adjusting positioning of the nozzles in the nozzle holder to dispose the nozzles in a second nozzle arrangement corresponding to a second arrangement of a second set of tubes of a tube bundle;

securing the nozzles in the nozzle holder in the second nozzle arrangement;

conducting a second tube engage operation comprising controlling the nozzle holder positioning system to move the nozzle holder in the third dimension to advance the outlets of the nozzles secured in the second nozzle arrangement into engagement with the inlets of the second set of tubes of the tube bundle;

conducting a second tube cleaning operation comprising directing cleaning fluid comprising a mixture of water vapor and media into the inlets of the second set of tubes by way of the outlets of the nozzles secured in the second nozzle arrangement and engaged with ends of the second set of tubes; and conducting a second tube disengage operation comprising controlling the nozzle holder positioning system to move the nozzle holder in the third dimension to retract the outlets of the nozzles secured in the second nozzle arrangement to disengage the outlets of the nozzles from the inlets of the second set of tubes of the tube bundle.

19. The method of claim 14, wherein the nozzle holder is configured to position at least one nozzle of the nozzles in a given position, wherein the nozzle holder is configured to enable variability of the position of at least one nozzle of the nozzles, wherein securing the nozzles in the nozzle holder comprises securing a first nozzle in the given position and securing a second nozzle in a position relative to the given position, wherein the position relative to the given position corresponds to the arrangement of tubes of the tube bundle.

20. The method of claim 19, wherein the nozzles comprise three nozzles, wherein the nozzle holder is configured to position the first nozzle of the nozzles in the given position, wherein the nozzle holder is configured to enable variability of lateral positioning of the second nozzle of the nozzles to a first side of the given position, and wherein the nozzle holder is configured to enable variability of lateral positioning of a third nozzle of the nozzles to a second side of the given position, wherein securing the nozzles in the nozzle holder comprises securing the first nozzle in the given position, securing the second nozzle in a second position offset from the given position by a distance corresponding to the arrangement of tubes of the tube bundle, and securing the third nozzle in a third position offset from the given position by a distance corresponding to the arrangement of tubes of the tube bundle.

21. The method of claim 14, wherein the arrangement of tubes of the tube bundle comprises a given tube spacing, and wherein the nozzle arrangement comprises a nozzle spacing corresponding to the given tube spacing.

22. The method of claim 14, wherein the nozzle arrangement is a linear arrangement comprising the outlets of the nozzles aligned linearly and offset by a given distance.

23. The method of claim 14, wherein the nozzle holder comprises:

a nozzle holder base configured to couple to a shuttle of the nozzle positioning system; and a nozzle holder cradle comprising nozzle retainers configured to engage an exterior of the of nozzles to secure the nozzles in the nozzle arrangement, wherein the nozzle cradle is configured to translate relative to the nozzle holder base to provide for movement of the nozzle holder cradle, the nozzle retainers and the nozzles secured in the nozzle holder cradle in the third dimension relative to the shuttle of the nozzle positioning system to position the outlets of the nozzles into engagement with the inlets of the tubes of the tube bundle, the tube engage operation comprising controlling the nozzle holder positioning system to translate the nozzle cradle forward in the third dimension relative to the nozzle holder base to advance the outlets of the nozzles into engagement with the inlets of the set of tubes of the tube bundle, and the tube disengage operation comprising controlling the nozzle holder positioning system to translate the nozzle cradle backwards in the third dimension relative to the nozzle holder base to retract the outlets of the nozzles to disengage engage the inlets of the set of tubes of the tube bundle.

24. The method of claim 23, wherein the nozzle holder cradle is coupled to the nozzle holder base by way of a slide mount configured to provide for sliding translation of the nozzle cradle in the third dimension relative to the nozzle holder base, the tube engage operation comprising:

controlling the nozzle holder positioning system to move the shuttle, the nozzle holder and the nozzles secured in the nozzle holder in the first and second dimensions to align the nozzles with the set of tubes of the tube bundle; and controlling the slide mount of the nozzle holder positioning system to translate the nozzle cradle forward in the third dimension relative to the nozzle holder base to advance the outlets of the nozzles into engagement with the inlets of the set of tubes of the tube bundle.

25. The method of claim 23, wherein the nozzle holder cradle is configured to pivot relative to the nozzle holder base about a pivot axis extending in the third dimension to provide for pivoting of the cradle and the nozzles relative to the shuttle of the nozzle positioning system, wherein securing nozzles in a nozzle holder of a nozzle positioning system in a nozzle arrangement comprises pivoting the nozzle holder cradle to pivot the nozzles into a position corresponding to the arrangement of the tubes of the tube bundle.

26. The method of claim 14, wherein the tube cleaning operation comprises a vapor blast cleaning operation comprising flowing the mixture of water vapor and media through the nozzles at a given flowrate for a given duration.

27. The method of claim 14, wherein the nozzle holder comprises a multi-nozzle holder configured to provide for independent movement of the nozzles relative to one another, and the method comprising conducting a second tube engage operation comprising controlling the nozzle holder positioning system to move a first nozzle of the nozzles into engagement with a tube of the tube bundle and position a second nozzle of the nozzles in a disengaged state.

28. The method of claim 14, wherein engagement of the outlets of the nozzles with the with inlets of the tubes of the tube bundle comprises sealing engagement, contact engagement or near contact engagement.

29. A non-transitory computer readable storage medium comprising program instructions stored thereon that are executable by a processor to perform the following operations for vapor blast cleaning tubes of a tube bundle comprising:

controlling a nozzle holder positioning system to conduct a tube engage operation comprising moving a nozzle holder in a third dimension to advance outlets of nozzles into engagement with inlets of a set of tubes of a tube bundle, the nozzles secured in the nozzle holder in a nozzle arrangement corresponding to an arrangement of the tubes of the tube bundle, the nozzle holder positioning system configured to move the nozzle holder and the nozzles secured therein relative to the tube bundle in a first dimension, a second dimension, and the third dimension to position the outlets of the nozzles into engagement with the inlets of the tubes of the tube bundle such that the nozzles are positioned to direct a cleaning fluid comprising a mixture of water vapor and media into the inlets of the tubes of the tube bundle while the inlets of the tubes of the tube bundle are engaged by the outlets of the nozzles to provide a vapor blast cleanse of the tubes of the tube bundle;

conducting a tube cleaning operation comprising directing cleaning fluid comprising a mixture of water vapor and media into the inlets of the set of tubes by way of the outlets of the nozzles engaged with the inlets of the set of tubes of the tube bundle; and conducting a tube disengage operation comprising controlling the nozzle holder positioning system to move the nozzle holder in the third dimension to retract the outlets of the nozzles in the third dimension to disengage the outlets of the nozzles from the inlets of the set of tubes of the tube bundle.

30. The medium of claim 29, wherein engagement of the outlets of the nozzles with the with inlets of the tubes of the tube bundle comprises sealing engagement, contact engagement or near contact engagement.

31. The medium of claim 29, the operations further comprising:

conducting a second tube engage operation comprising controlling the nozzle holder positioning system to move the nozzle holder in the third dimension to advance the outlets of the nozzles into engagement with inlets of a second set of tubes of the tube bundle;

conducting a second tube cleaning operation comprising directing cleaning fluid comprising a mixture of water vapor and media into the inlets of the second set of tubes by way of the outlets of the nozzles engaged with ends of the second set of tubes; and conducting a second tube disengage operation comprising controlling the nozzle holder positioning system to move the nozzle holder in the third dimension to retract the outlets of the nozzles to disengage the outlets of the nozzles from the inlets of the second set of tubes of the tube bundle.

32. The medium of claim 29, the nozzle holder comprising:

a nozzle cradle; and one or more nozzle retainers, wherein the one or more nozzle retainers are configured to secure the nozzles in the nozzle cradle in the nozzle arrangement, and wherein the nozzles are secured in the nozzle holder using the one or more nozzle retainers.

33. The medium of claim 32, wherein the one or more nozzle retainers hold the nozzles against the nozzle cradle to secure the nozzles in the nozzle arrangement.

34. The medium of claim 29, the positioning of the nozzles in the nozzle holder being adjusted to secure the nozzles in a second nozzle arrangement corresponding to a second arrangement of a second set of tubes of a tube bundle, the operations further comprising:

conducting a second tube engage operation comprising controlling the nozzle holder positioning system to move the nozzle holder in the third dimension to advance the outlets of the nozzles secured in the second nozzle arrangement into engagement with the inlets of the second set of tubes of the tube bundle;

conducting a second tube cleaning operation comprising directing cleaning fluid comprising a mixture of water vapor and media into the inlets of the second set of tubes by way of the outlets of the nozzles secured in the second nozzle arrangement and engaged with ends of the second set of tubes; and conducting a second tube disengage operation comprising controlling the nozzle holder positioning system to move the nozzle holder in the third dimension to retract the outlets of the nozzles secured in the second nozzle arrangement to disengage the outlets of the nozzles from the inlets of the second set of tubes of the tube bundle.

35. The medium of claim 29, wherein the nozzle holder is configured to position at least one nozzle of the nozzles in a given position, wherein the nozzle holder is configured to enable variability of the position of at least one nozzle of the nozzles, the nozzles comprising a first nozzle secured in the given position and a second nozzle secured in a position relative to the given position, wherein the position relative to the given position corresponds to the arrangement of tubes of the tube bundle.

36. The medium of claim 35, wherein the nozzles comprise three nozzles, wherein the nozzle holder is configured to position the first nozzle of the nozzles in the given position, wherein the nozzle holder is configured to enable variability of lateral positioning of the second nozzle of the nozzles to a first side of the given position, and wherein the nozzle holder is configured to enable variability of lateral positioning of a third nozzle of the nozzles to a second side of the given position, wherein the nozzles comprise the first nozzle secured in the given position, the second nozzle secured in a second position offset from the given position by a distance corresponding to the arrangement of tubes of the tube bundle, and the third nozzle secured in a third position offset from the given position by a distance corresponding to the arrangement of tubes of the tube bundle.

37. The medium of claim 29, wherein the arrangement of tubes of the tube bundle comprises a given tube spacing, and wherein the nozzle arrangement comprises a nozzle spacing corresponding to the given tube spacing.

38. The medium of claim 29, wherein the nozzle arrangement is a linear arrangement comprising the outlets of the nozzles aligned linearly and offset by a given distance.

39. The medium of claim 29, wherein the nozzle holder comprises:

a nozzle holder base configured to couple to a shuttle of the nozzle positioning system; and a nozzle holder cradle comprising nozzle retainers configured to engage an exterior of the of nozzles to secure the nozzles in the nozzle arrangement, wherein the nozzle cradle is configured to translate relative to the nozzle holder base to provide for movement of the nozzle holder cradle, the nozzle retainers and the nozzles secured in the nozzle holder cradle in the third dimension relative to the shuttle of the nozzle positioning system to position the outlets of the nozzles into engagement with the inlets of the tubes of the tube bundle, the tube engage operation comprising controlling the nozzle holder positioning system to translate the nozzle cradle forward in the third dimension relative to the nozzle holder base to advance the outlets of the nozzles into engagement with the inlets of the set of tubes of the tube bundle, and the tube disengage operation comprising controlling the nozzle holder positioning system to translate the nozzle cradle backwards in the third dimension relative to the nozzle holder base to retract the outlets of the nozzles to disengage engage the inlets of the set of tubes of the tube bundle.

40. The medium of claim 39, wherein the nozzle holder cradle is coupled to the nozzle holder base by way of a slide mount configured to provide for sliding translation of the nozzle cradle in the third dimension relative to the nozzle holder base, the tube engage operation comprising:

controlling the nozzle holder positioning system to move the shuttle, the nozzle holder and the nozzles secured in the nozzle holder in the first and second dimensions to align the nozzles with the set of tubes of the tube bundle; and controlling the slide mount of the nozzle holder positioning system to translate the nozzle cradle forward in the third dimension relative to the nozzle holder base to advance the outlets of the nozzles into engagement with the inlets of the set of tubes of the tube bundle.

41. The medium of claim 39, wherein the nozzle holder cradle is configured to pivot relative to the nozzle holder base about a pivot axis extending in the third dimension to provide for pivoting of the cradle and the nozzles relative to the shuttle of the nozzle positioning system, wherein the nozzle holder cradle is pivoted to pivot the nozzles into a position corresponding to the arrangement of the tubes of the tube bundle.

42. The medium of claim 29, wherein the tube cleaning operation comprises a vapor blast cleaning operation comprising flowing the mixture of water vapor and media through the nozzles at a given flowrate for a given duration.

43. The medium of claim 29, wherein the nozzle holder comprises a multi-nozzle holder configured to provide for independent movement of the nozzles relative to one another, and the operations comprising conducting a second tube engage operation comprising controlling the nozzle holder positioning system to move a first nozzle of the nozzles into engagement with a tube of the tube bundle and position a second nozzle of the nozzles in a disengaged state.

* * * * *